US012680788B2

(12) United States Patent
Prikhodko

(10) Patent No.: US 12,680,788 B2
(45) Date of Patent: Jul. 14, 2026

(54) TITANIUM-BASED LAMINATE STRUCTURES FABRICATED USING BLENDED ELEMENTAL POWDER METALLURGY AND HOT ISOSTATIC PRESSING

(71) Applicant: Sergey Prikhodko, Los Angeles, CA (US)

(72) Inventor: Sergey Prikhodko, Los Angeles, CA (US)

( * ) Notice: Subject to any disclaimer, the term of this patent is extended or adjusted under 35 U.S.C. 154(b) by 0 days.

(21) Appl. No.: 18/616,467

(22) Filed: Mar. 26, 2024

(65) Prior Publication Data

US 2025/0305798 A1 Oct. 2, 2025

(51) Int. Cl.

| | |
|---|---|
| ***F41H 5/04*** | (2006.01) |
| ***C22C 1/051*** | (2023.01) |
| ***C22C 29/10*** | (2006.01) |
| *B22F 3/15* | (2006.01) |

(52) U.S. Cl.

CPC ..... *F41H 5/045* (2013.01); *C22C 1/051* (2013.01); *C22C 29/10* (2013.01); *B22F 3/15* (2013.01); *B22F 2301/205* (2013.01); *B22F 2302/10* (2013.01)

(58) Field of Classification Search

CPC .. B22F 3/15; B22F 2301/205; B22F 2302/10; C22C 1/051; C22C 29/10; F41H 5/045

See application file for complete search history.

(56) References Cited

U.S. PATENT DOCUMENTS

| | | | | |
|---|---|---|---|---|
| 5,256,368 A | 10/1993 | Oden et al. | | |
| 5,277,973 A | 1/1994 | Yamamura et al. | | |
| 5,744,254 A * | 4/1998 | Kampe | B22F 1/12 | 428/614 |
| 2003/0161750 A1* | 8/2003 | Moxson | C22C 32/00 | 148/421 |
| 2004/0146736 A1 | 7/2004 | Ivanov et al. | | |
| 2010/0143176 A1 | 6/2010 | Tanimoto et al. | | |
| 2019/0049222 A1* | 2/2019 | Von Blücher | F41H 5/0492 | |
| 2019/0070789 A1 | 3/2019 | Yousefiani et al. | | |

(Continued)

FOREIGN PATENT DOCUMENTS

| | | | |
|---|---|---|---|
| CN | 101011739 A * | 8/2007 | |
| CN | 109295343 A * | 2/2019 | B22F 10/28 |
| UA | 114876 C2 * | 8/2017 | |

OTHER PUBLICATIONS

"Titanium Armor with Gradient Structure: Advanced Technology for Fabrication", Prikhodko et al., NATO Science for Peace and Security Series B: Physics and Biophysics, Chapter 13, pp. 127-140, Jun. 27, 2020 (Prikhodko) (Year: 2020).*

(Continued)

*Primary Examiner* — Humera N. Sheikh

*Assistant Examiner* — Julia L Rummel

(74) *Attorney, Agent, or Firm* — POLSINELLI PC

(57) ABSTRACT

The present disclosure is directed to a laminate structure and method of making the laminate structure. The laminate structure includes an alloy layer and one or more metal matrix composite (MMC) layers. The alloy layer includes a titanium alloy. Each MMC layer includes a titanium alloy reinforced with 5 vol. % to 50 vol. % particles of TiC or TiB. The alloy layer and the one or more MMC layers are joined by applying hot isostatic pressing.

18 Claims, 15 Drawing Sheets

(56) References Cited

U.S. PATENT DOCUMENTS

2022/0376226 A1 11/2022 Herle

OTHER PUBLICATIONS

In Situ Synthesis of Titanium Matrix Composite (Ti—TiB—TiC) through Sintering of TiH2—B4C, Jimoh et al., Materials Sciences and Applications, vol. 3, 2012, pp. 30-35 (Jimoh) (Year: 2012).*
English language translation of CN 109295343 A, generated on Sep. 16, 2025 with Espacenet website (https://worldwide.espacenet.com/) *Paragraph numbers added.*
English language tranlation of CN 101011739 A, generated on Sep. 17, 2025 with Espacenet website (https://worldwide.espacenet.com/) *Paragraph numbers added.*
Chandran, K.; Panda, K.; Sahay, S.; "TiBw-Reinforced Ti Composites: Processing, Properties, Application Prospects, and Research Needs", Journal of Minderals, Metals, and Materials Society, 2004, p. 42-48.*
Azo Materials, "Titanium Alloys—Ti6Al4V Grade 5", p. 1; Accessed on Sep. 17, 2025 at https://www.azom.com/properties.aspx?ArticleID=1547.*
S.V. Prikhodko, O.M. Ivasishin, P.E. Markovsky, D.G. Savvakin, O.O. Stasiuk, Titanium Armor with Gradient Structure: Advanced Technology for Fabrication, Advanced Technologies for Security Applications: Proceedings of the NATO Science for Peace and Security Cluster Workshop on Advanced Technologies, Sep. 17-18, 2019, Leuven, Belgium, Springer, Ed. Claudio Palestini (2020) 127-143. doi.org/10.1007/978-94-024-2021-0.
S.V. Prikhodko, D.G. Savvakin, P.E. Markovsky, O.O. Stasuk, J. Penney, N. Enzingen, M. Gaskil, & F. Deley, Friction welding of conventional Ti—6Al—4V alloy with a Ti—6Al—4V based metal matrix composite reinforced by TiC, Welding in the World, 65 (2021) 415-428. DOI:10.1007/s40194-020-01025-8.
Prikhodko, et al., Thermo-Mechanical Treatment of Titanium Based Layered Structures Fabricated by Blended Elemental Powder Metallurgy, Materials Science Forum, 2018, vol. 941, pp. 1384-1390.
Ivasishin, et al., Multi-layered structures of Ti-6A1-4V alloy and TiC and TiB composites on its base fabricated using blended elemental powder metallurgy, Journal of Materials Processing Tech., 2019, vol. 269, pp. 172-181.
Jul. 9, 2025—International Search Report and Written Opinion, PCT/US2024/020980, 17 pages.
Markovsky et al. "Ballistic performance of titanium-based layered composites made using blended elemental powder metallurgy and hot isostatic pressing," Apr. 15, 2024, Defence Technology 39 (2024) pp. 1-14.

* cited by examiner

FIG. 13A

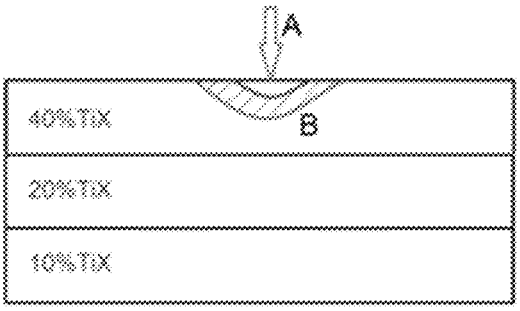

A - First shot caused small crater;
B - Probable field of internal stresses.

FIG. 13B

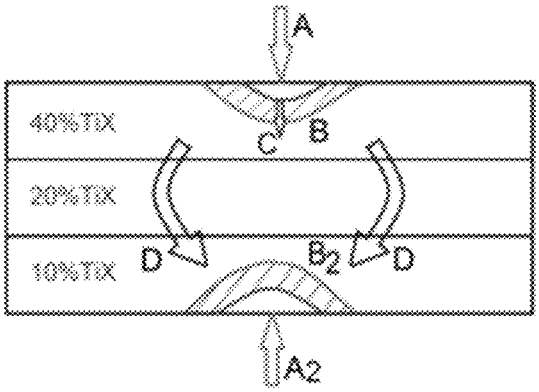

A - First shot caused small crater;
$A_2$ - Second shot caused bigger crater;
B, $B_2$ - Probable fields of internal stresses;
C - Crack initiation from stress concentrator;
D - Bending forces from the second shot.

FIG. 13C

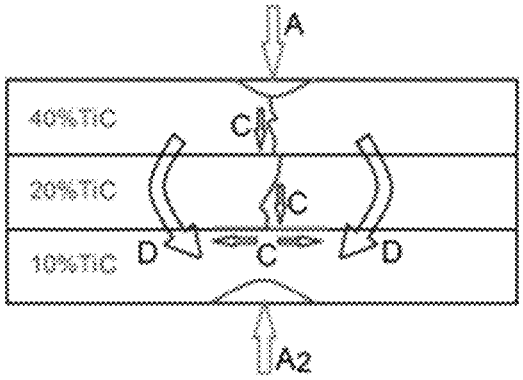

A - First shot caused small crater;
$A_2$ - Second shot caused bigger crater;
C - Crack propagation route;
D - Bending forces from the second shot.

(c)

FIG. 13D

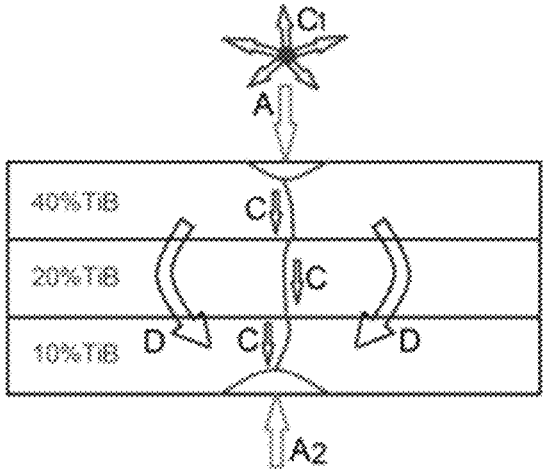

A - First shot caused small crater;
$A_2$ - Second shot caused bigger crater;
C - Crack propagation route,center view;
$C_1$ - Cracks propagation, top view;
D - Bending forces from the second shot.

(d)

TITANIUM-BASED LAMINATE STRUCTURES FABRICATED USING BLENDED ELEMENTAL POWDER METALLURGY AND HOT ISOSTATIC PRESSING

BACKGROUND

The application of titanium alloys as structural materials is primarily based on their high specific strength well-balanced with other mechanical characteristics and high corrosion resistance. For that reason, titanium alloys are used in the aerospace, automotive, medical, and military products. In the latter case, titanium alloys are very desired materials to be used in armor elements fabrication. For such an application, it is important to have a part which has high hardness and strength values on the front surface layer and high ductility in the core of the element. One of the most promising ways to solve this problem successfully is to manufacture laminates using the powder metallurgy. Considered laminates can combine ductile layers made, for instance, of Ti-6Al-4V (wt. %) (Ti64) alloy well known for its good ductility and layers of much harder composites based on Ti64 alloy and reinforced with hard particles of TiC or TiB. Besides, such laminate structures made of alloy and metal matrix composites (MMC) can be fabricated by using relatively simple and low-cost press-and-sinter Blended Elemental Powder Metallurgy (BEPM) using titanium hydride $TiH_2$ as a base powder.

Owing to presence of hard reinforcing particles in MMC layer of the laminate, the surface hardness was increased from about 340 HV common for conventional Ti64 alloy, to 400-430 HV when 20% of TiC particles were added to the MMC of the top layer. However, effective protection against the piercing action of steel armor bullet having the higher hardness (above 700 HV) needs further increase in the hardness of the armor material. For Ti-based armor materials it could be achieved via an increase in the content of hard TiC or TiB particles, elimination of residual porosity in sintered MMC and alloys and proper processing of the materials followed their BEPM manufacture contributing to an increase of content of the hard phase and decrease in porosity. Residual porosity is inevitably present in pressed and sintered powder parts, and the most common method of its fixation in BEPM products is the further application of hot pressing or hot rolling of sintered parts. Such post-treatment cannot be used on laminates due to the disparity in plastic flow of different layers. Therefore, there is a need for modified processing of laminates to improve hardness and porosity of the material.

SUMMARY

Disclosed herein is a laminate structure including: an alloy layer comprising a titanium alloy; and one or more metal matrix composite (MMC) layers, each MMC layer comprising a titanium alloy reinforced with 5 vol. % to 50 vol. % particles of TiC or TiB. The alloy layer and the one or more MMC layers are joined by applying hot isostatic pressing (HIP). The titanium alloy is an α-β titanium alloy, such as Ti-6Al-4V. In various aspects, each MMC layer is individually fabricated and processed using Blended Elemental Powder Metallurgy (BEPM) treatment prior to applying the HIP.

Some aspects of the present disclosure include that the one or more MMC layers are reinforced with no more than 45 vol. % TiC, no more than 40 vol. % TiC, no more than 45 vol. % TiB, and/or no more than 40 vol. % TiB.

In some aspects, the laminate structure includes two or more MMC layers. For example, the laminate structure can include a first MMC layer reinforced with TiC and a second MMC layer reinforced with TiC, a first MMC layer reinforced with TiB and a second MMC layer reinforced with TiB, or a first MMC layer reinforced with TiC and a second MMC layer reinforced with TiB, or any variation thereof. The first MMC layer and the second MMC layer may include different amounts of TiC and TiB, respectively.

In some aspects, the laminate structure has a porosity of ≤4%, ≤3%, ≤2%, ≤1%, or ≤0.1%. The porosity of the two or more MMC layers decreases by at least 10% after applying HIP. In some examples, residual porosity is eliminated after applying HIP. In various aspects, the two or more MMC layers have a hardness greater than 500 HV, greater than 600 HV, greater than 700 HV, greater than 750 HV, or greater than 775 HV after applying HIP. Due to the reduced porosity and increased hardness, the laminate structure has improved mechanical and antiballistic protective characteristics as compared to a structure formed without applying HIP.

In some aspects, the laminate structure includes $Ti_3AlC$. The one or more MMC layers may include a reinforcement phase comprising $Ti_2C$ and $Ti_3AlC$ or TiB. For example, the reinforcement phase may include 5 wt. % to 20 wt. % $Ti_3AlC$. In another example, the reinforcement phase gradually increases from 0 wt. % TiC or TiB at the alloy layer up to 50 wt. % within an outer MMC layer.

In some aspects, the laminate structure is in the form of a plate, cylinder, washer, or any other substantially flat shape. The plate may have a length of about 90 mm to about 30 cm, a width of about 90 mm to about 30 cm, and a thickness of about 10 mm to about 5 cm.

Also provided herein is a method of manufacturing a laminate structure, the method including: fabricating a first MMC layer comprising a titanium alloy and 5 vol. % to 50 vol. % TiC or TiB using BEPM treatment; and bonding an alloy layer comprising a titanium alloy and the first MMC layer by applying HIP, thereby forming the laminate structure. In some aspects, the titanium alloy is Ti-6Al-4V.

In some aspects, the method may further include fabricating one or more additional MMC layers comprising a titanium alloy and 5 vol. % to 40 vol. % TiC or TiB using BEPM treatment, where the one or more additional MMC layers are bonded to the first MMC layer or subsequent MMC layers by applying HIP. The first MMC layer may be reinforced with TiC or TiB and the one or more additional MMC layers may be reinforced with TiC or TiB, or any variation thereof. The first MMC layer and the one or more additional MMC layers include different amounts of TiC or TiB, respectively.

In some aspects, the HIP is performed at about 800° C. to about 1000° C. and about 100 MPa to about 200 MPa for about 3 hours to about 5 hours.

BRIEF DESCRIPTION OF THE DRAWINGS

FIG. 4D was collected using SE and FIGS. 4E & F collected using backscattered electrons (BSE).

FIG. 5D is an elemental map and FIG. 5E is a location for the point analysis listed in Table 3.

FIG. 7A is a view on the 40 vol. % layer side. FIG. 7B is a view on the 10 vol. % particles layer side.

FIGS. 13A-D are general schemes of crack nucleation and propagation after the first (A), and the second (B) shots, and difference for cases reinforcement with TiC (C) and TiB (D) particles.

FIG. 15B shows that a large portion of material was lost during metallographic sample preparation and the accurately measured "empty" areas A on the polished surface using Image J do not represent the porosity expected in bulk. It also can be seen that some of the lost material or pores is filled with colloidal silica (flat, dark grey regions B), used on the final stage of polishing. FIG. 15A shows that before HIP treatment the stiff framework of the sample is made of the chain of small particles of TiC, which can be easily broken during the HIP treatment and the structure become very fragile. It can be seen that for TiB composites the situation is less acute and there are still enough of the ductile phase (areas C) to bond the needles of TiB in the consolidated structure.

DETAILED DESCRIPTION

Figure 1A:
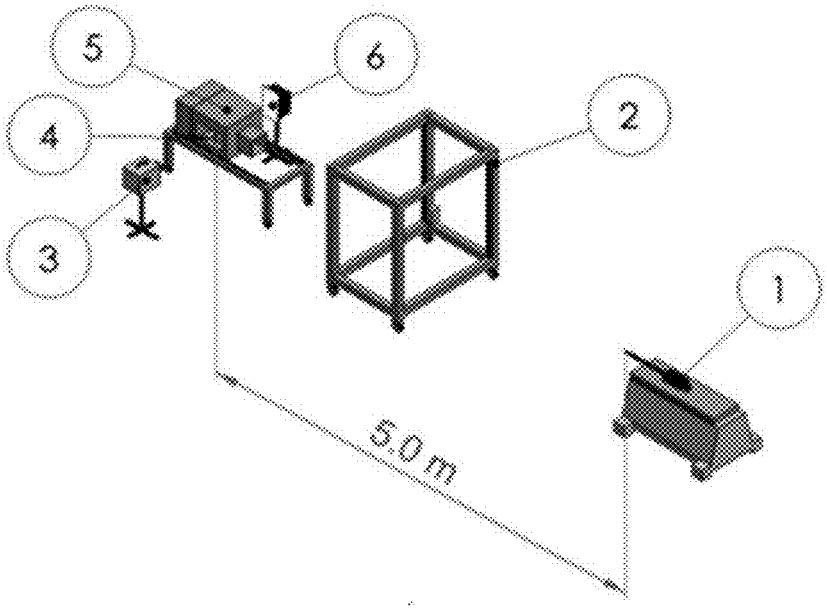
FIG. 1A is a schematic illustration of the stand for ballistic tests according to the present disclosure. The labels correspond to: 1) mobile firing rest STZA 13M2 equipped with ballistic barrel; 2) projectile velocity measurement light screen Kistler 2521A; 3) high speed camera Phantom v1612; 4) and 5) specimen mount with anti-debris protective cover, armored glass window and bullet catcher; and 6) LED light source.

To overcome some of the difficulties described above in processing laminates, hot isostatic pressing (HIP) can be incorporated as part of the treatment cycle as an effective method of eliminating residual porosity of sintered products. In addition, proper temperature-pressure-time control of the HIP processing can increase the content of the reinforcing phases, facilitate uniform shrinkage of the BEPM parts, and assuredly connect the individual layers to form the laminate. Also recently, a very favorable effect of high temperature aging of TiC+Ti64 composites after sintering has been shown to produce structures with outstanding hardness; and such aging is basically one of the natural consequences of HIP treatment. So, HIP can be effectively used for joining of separately sintered layers with different content of reinforcements into integral laminate structure. Although the added HIP treatment may increase the cost of the entire technological process, its use can be justified by a significant improvement in the mechanical characteristics of the final products.

The present disclosure is directed to a laminate structure. The laminate structure may include an alloy layer. The alloy layer may include a titanium alloy. The laminate structure may include one or more metal matrix composite (MMC) layers. Each MMC layer may include a titanium alloy reinforced with 5 vol. % to 50 vol. % particles of TiC or TiB. The alloy layer and the one or more MMC layers may be joined by applying hot isostatic pressing.

The present disclosure is also directed to a method of manufacturing a laminate structure. The method includes fabricating a first MMC layer including a titanium alloy and 5 vol. % to 50 vol. % TiC or TiB using BEPM treatment; and bonding an alloy layer including a titanium alloy and the first MMC layer by applying HIP, thereby forming the laminate structure.

The present disclosure is also directed to evaluate the potential of BEPM in combination with HIP to make a laminate. The BEPM may use $TiH_2$ as base powder to make composites with relatively high (up to 40% vol.) content of reinforcing phase and HIP treatment may be used after sintering to create laminates with improved microstructure, mechanical and antiballistic protective characteristics.

Superior performance of laminate structures may be achieved by processing each layer individually, providing a piece layer of optimal properties and further layer bonding. Layered structures of Ti64 alloy composites reinforced with TiC or TiB particles may be bonded using HIP. Plates (laminate structures) may be made using BEPM, where the amount of reinforcement can be changed: e.g., 5, 10, 20, 40, 50% (vol.). Bonded structures may have antiballistic resistance. Without being limited to any one theory, powder metallurgy and HIP processing may contribute to the performance of the laminate structure. For example, the combination of the two technologies, BEPM and HIP, is principally complimentary with the ability to solve the essential problems of each when used individually.

Definitions

Before the present compositions, articles, systems, devices, and/or methods are disclosed and described, it is to be understood that they are not limited to specific synthetic methods unless otherwise specified, or to particular reagents unless otherwise specified, as such may, of course, vary. It is also to be understood that the terminology used herein is for the purpose of describing particular aspects only and is not intended to be limiting. Although any methods and materials similar or equivalent to those described herein can be used in the practice or testing of the present invention, example methods and materials are now described.

This disclosure describes inventive concepts with reference to specific examples. However, the intent is to cover all modifications, equivalents, and alternatives of the inventive concepts that are consistent with this disclosure.

As used in the specification and the appended claims, the singular forms "a", "an", and "the" include plural referents unless the context clearly dictates otherwise.

The phrase 'consisting essentially of' limits the scope of a claim to the recited components in a composition or the recited steps in a method as well as those that do not materially affect the basic and novel characteristic or characteristics of the claimed composition or claimed method. The phrase 'consisting of' excludes any component, step, or element that is not recited in the claim. The phrase 'comprising' is synonymous with 'including', 'containing', or 'characterized by', and is inclusive or open-ended. 'Comprising' does not exclude additional, unrecited components or steps.

As used herein, when referring to any numerical value, the term 'about' means a value falling within a range that is ±10% of the stated value.

Ranges can be expressed herein as from 'about' one particular value, and/or to 'about' another particular value. When such a range is expressed, a further aspect includes from the one particular value and/or to the other particular value. Similarly, when values are expressed as approximations, by use of the antecedent 'about,' it will be understood that the particular value forms a further aspect. It will be further understood that the endpoints of each of the ranges are significant both in relation to the other endpoint and independently of the other endpoint. It is also understood that there are a number of values disclosed herein, and that each value is also herein disclosed as 'about' that particular value in addition to the value itself. For example, if the value '10' is disclosed, then 'about 10' is also disclosed. It is also understood that each unit between two particular units are also disclosed. For example, if 10 and 15 are disclosed, then 11, 12, 13, and 14 are also disclosed.

References in the specification and concluding claims to parts by weight of a particular element or component in a composition denotes the weight relationship between the element or component and any other elements or components in the composition or article for which a part by weight is expressed. Thus, in a compound containing 2 parts by weight component X and 5 parts by weight component Y, X and Y are present at a weight ratio of 2:5, and are present in such ratio regardless of whether additional components are contained in the composition.

As used herein, the terms 'optional' or 'optionally' means that the subsequently described event or circumstance can or cannot occur, and that the description includes instances where said event or circumstance occurs and instances where it does not. In an aspect, a disclosed method can optionally comprise one or more additional steps, such as, for example, repeating an administering step or altering an administering step.

The present disclosure also contemplates that in some aspects, any feature or combination of features set forth herein can be excluded or omitted. To illustrate, if the specification states that a complex comprises components A, B and C, it is specifically intended that any of A, B or C, or a combination thereof, can be omitted and disclaimed singularly or in any combination.

Laminate Structure

The laminate structure may include a titanium alloy layer and one or more MMC layers. Each MMC layer may include a titanium alloy reinforced with 5 vol. % to 50 vol. % particles of TiC or TiB. The alloy layer and the one or more MMC layers may be joined by applying hot isostatic pressing.

The titanium alloy may be an α-β titanium alloy. In some embodiments, the titanium alloy may be Ti64.

The laminate structure may include one or more MMC layers. For example, the laminate structure may include one, two, three, four, five, six, seven, eight, nine, or ten MMC layers. Each MMC layer may be individually fabricated and processed using Blended Elemental Powder Metallurgy (BEPM) treatment prior to applying the HIP.

Each MMC layer may include a titanium alloy reinforced with particles of TiC or TiB. The amount of particles may range from about 5 vol. % to about 50 vol. % particles of TiC or TiB. For example, the amount of particles may be about 5.5 vol. %, about 6.0 vol. %, about 6.5 vol. %, about 7.0 vol. %, about 7.5 vol. %, about 8.0 vol. %, about 8.5 vol. %, about 9.0 vol. %, about 9.5 vol. %, about 10.0 vol. %, about 10.5 vol. %, about 11.0 vol. %, about 11.5 vol. %, about 12.0 vol. %, about 12.5 vol. %, about 13.0 vol. %, about 13.5 vol. %, about 14.0 vol. %, about 14.5 vol. %, about 15.0 vol. %, about 15.5 vol. %, about 16.0 vol. %, about 16.5 vol. %, about 17.0 vol. %, about 17.5 vol. %, about 18.0 vol. %, about 18.5 vol. %, about 19.0 vol. %, about 19.5 vol. %, about 20.0 vol. %, about 20.5 vol. %, about 21.0 vol. %, about 21.5 vol. %, about 22.0 vol. %, about 22.5 vol. %, about 23.0 vol. %, about 23.5 vol. %, about 24.0 vol. %, about 24.5 vol. %, about 25.0 vol. %, about 25.5 vol. %, about 26.0 vol. %, about 26.5 vol. %, about 27.0 vol. %, about 27.5 vol. %, about 28.0 vol. %, about 28.5 vol. %, about 29.0 vol. %, about 29.5 vol. %, about 30.0 vol. %, about 30.5 vol. %, about 31.0 vol. %, about 31.5 vol. %, about 32.0 vol. %, about 32.5 vol. %, about 33.0 vol. %, about 33.5 vol. %, about 34.0 vol. %, about 34.5 vol. %, about 35.0 vol. %, about 35.5 vol. %, about 36.0 vol. %, about 36.5 vol. %, about 37.0 vol. %, about 37.5 vol. %, about 38.0 vol. %, about 38.5 vol. %, about 39.0 vol. %, about 39.5 vol. %, about 40.0 vol. %, about 40.5 vol. %, about 41.0 vol. %, about 41.5 vol. %, about 42.0 vol. %, about 42.5 vol. %, about 43.0 vol. %, about 43.5 vol. %, about 44.0 vol. %, about 44.5 vol. %, about 45.0 vol. %, about 45.5 vol. %, about 46.0 vol. %, about 46.5 vol. %, about 47.0 vol. %, about 47.5 vol. %, about 48.0 vol. %, about 48.5 vol. %, about 49.0 vol. %, about 49.5 vol. %, or about 50.0 vol. % of TiC particles in a titanium alloy.

In other examples, the amount of particles may be about 5.5 vol. %, about 6.0 vol. %, about 6.5 vol. %, about 7.0 vol. %, about 7.5 vol. %, about 8.0 vol. %, about 8.5 vol. %, about 9.0 vol. %, about 9.5 vol. %, about 10.0 vol. %, about 10.5 vol. %, about 11.0 vol. %, about 11.5 vol. %, about 12.0 vol. %, about 12.5 vol. %, about 13.0 vol. %, about 13.5 vol. %, about 14.0 vol. %, about 14.5 vol. %, about 15.0 vol. %, about 15.5 vol. %, about 16.0 vol. %, about 16.5 vol. %, about 17.0 vol. %, about 17.5 vol. %, about 18.0 vol. %, about 18.5 vol. %, about 19.0 vol. %, about 19.5 vol. %, about 20.0 vol. %, about 20.5 vol. %, about 21.0 vol. %, about 21.5 vol. %, about 22.0 vol. %, about 22.5 vol. %, about 23.0 vol. %, about 23.5 vol. %, about 24.0 vol. %, about 24.5 vol. %, about 25.0 vol. %, about 25.5 vol. %, about 26.0 vol. %, about 26.5 vol. %, about 27.0 vol. %, about 27.5 vol. %, about 28.0 vol. %, about 28.5 vol. %, about 29.0 vol. %, about 29.5 vol. %, about 30.0 vol. %, about 30.5 vol. %, about 31.0 vol. %, about 31.5 vol. %, about 32.0 vol. %, about 32.5 vol. %, about 33.0 vol. %, about 33.5 vol. %, about 34.0 vol. %, about 34.5 vol. %, about 35.0 vol. %, about 35.5 vol. %, about 36.0 vol. %, about 36.5 vol. %, about 37.0 vol. %, about 37.5 vol. %, about 38.0 vol. %, about 38.5 vol. %, about 39.0 vol. %, about 39.5 vol. %, about 40.0 vol. %, about 40.5 vol. %, about 41.0 vol. %, about 41.5 vol. %, about 42.0 vol. %, about 42.5 vol. %, about 43.0 vol. %, about 43.5 vol. %, about 44.0 vol. %, about 44.5 vol. %, about 45.0 vol. %, about 45.5 vol. %, about 46.0 vol. %, about 46.5 vol. %, about 47.0 vol. %, about 47.5 vol. %, about 48.0 vol. %, about 48.5 vol. %, about 49.0 vol. %, about 49.5 vol. %, or about 50.0 vol. % of TiB particles in a titanium alloy.

In some embodiments, the one or more MMC layers are reinforced with no more than 45 vol. % TiC. In other embodiments, the one or more MMC layers are reinforced with no more than 40 vol. % TiC. In some embodiments, the one or more MMC layers are reinforced with no more than 45 vol. % TiB. In other embodiments, the one or more MMC layers are reinforced with no more than 40 vol. % TiB.

In some embodiments, the laminate structure may include a first MMC layer reinforced with TiC and a second MMC layer reinforced with TiC. The first MMC layer and the second MMC layer may include different amounts of TiC. It is further contemplated that the laminate structure may have more than two TiC MMC layers.

In other embodiments, the laminate structure may include a first MMC layer reinforced with TiB and a second MMC layer reinforced with TiB. The first MMC layer and the second MMC layer may include different amounts of TiB. It is further contemplated that the laminate structure may have more than two TiB MMC layers.

In some embodiments, the laminate structure may include a first MMC layer reinforced with TiC and a second MMC layer reinforced with TiB, or any variation thereof. The first MMC layer and the second MMC layer may include different amounts of TiC and TiB, respectively. It is further contemplated that the laminate structure may have two or more TiB MMC layers and/or two or more TiC MMC layers.

The laminate may include a reinforcement phase. The reinforcement phase may include $Ti_2C$, $Ti_3AlC$, TiB, or combinations thereof. In some embodiments, the one or more MMC layers may include a reinforcement phase of $Ti_2C$ and $Ti_3AlC$. In some embodiments, the one or more MMC layers may include a reinforcement phase of TiB.

The reinforcement phase may include from about 5 wt. % to about 20 wt. % $Ti_3AlC$. For example, the amount of $Ti_3AlC$ may be about 5.0 wt. %, about 5.1 wt. %, about 5.2 wt. %, about 5.3 wt. %, about 5.4 wt. %, about 5.5 wt. %, about 5.6 wt. %, about 5.7 wt. %, about 5.8 wt. %, about 5.9 wt. %, about 6.0 wt. %, about 6.1 wt. %, about 6.2 wt. %, about 6.3 wt. %, about 6.4 wt. %, about 6.5 wt. %, about 6.6 wt. %, about 6.7 wt. %, about 6.8 wt. %, about 6.9 wt. %, about 7.0 wt. %, about 7.1 wt. %, about 7.2 wt. %, about 7.3 wt. %, about 7.4 wt. %, about 7.5 wt. %, about 7.6 wt. %, about 7.7 wt. %, about 7.8 wt. %, about 7.9 wt. %, about 8.0 wt. %, about 8.1 wt. %, about 8.2 wt. %, about 8.3 wt. %, about 8.4 wt. %, about 8.5 wt. %, about 8.6 wt. %, about 8.7 wt. %, about 8.8 wt. %, about 8.9 wt. %, about 9.0 wt. %, about 9.1 wt. %, about 9.2 wt. %, about 9.3 wt. %, about 9.4 wt. %, about 9.5 wt. %, about 9.6 wt. %, about 9.7 wt. %, about 9.8 wt. %, about 9.9 wt. %, about 10.0 wt. %, about 10.1 wt. %, about 10.2 wt. %, about 10.3 wt. %, about 10.4 wt. %, about 10.5 wt. %, about 10.6 wt. %, about 10.7 wt. %, about 10.8 wt. %, about 10.9 wt. %, about 11.0 wt. %, about 11.1 wt. %, about 11.2 wt. %, about 11.3 wt. %, about 11.4 wt. %, about 11.5 wt. %, about 11.6 wt. %, about 11.7 wt. %, about 11.8 wt. %, about 11.9 wt. %, about 12.0 wt. %, about 12.1 wt. %, about 12.2 wt. %, about 12.3 wt. %, about 12.4 wt. %, about 12.5 wt. %, about 12.6 wt. %, about 12.7 wt. %, about 12.8 wt. %, about 12.9 wt. %, about 13.0 wt. %, about 13.1 wt. %, about 13.2 wt. %, about 13.3 wt. %, about 13.4 wt. %, about 13.5 wt. %, about 13.6 wt. %, about 13.7 wt. %, about 13.8 wt. %, about 13.9 wt. %, about 14.0 wt. %, about 14.1 wt. %, about 14.2 wt. %, about 14.3 wt. %, about 14.4 wt. %, about 14.5 wt. %, about 14.6 wt. %, about 14.7 wt. %, about 14.8 wt. %, about 14.9 wt. %, about 15.0 wt. %, about 15.1 wt. %, about 15.2 wt. %, about 15.3 wt. %, about 15.4 wt. %, about 15.5 wt. %, about 15.6 wt. %, about 15.7 wt. %, about 15.8 wt. %, about 15.9 wt. %, about 16.0 wt. %, about 16.1 wt. %, about 16.2 wt. %, about 16.3 wt. %, about 16.4 wt. %, about 16.5 wt. %, about 16.6 wt. %, about 16.7 wt. %, about 16.8 wt. %, about 16.9 wt. %, about 17.0 wt. %, about 17.1 wt. %, about 17.2 wt. %, about 17.3 wt. %, about 17.4 wt. %, about 17.5 wt. %, about 17.6 wt. %, about 17.7 wt. %, about 17.8 wt. %, about 17.9 wt. %, about 18.0 wt. %, about 18.1 wt. %, about 18.2 wt. %, about 18.3 wt. %, about 18.4 wt. %, about 18.5 wt. %, about 18.6 wt. %, about 18.7 wt. %, about 18.8 wt. %, about 18.9 wt. %, about 19.0 wt. %, about 19.1 wt. %, about 19.2 wt. %, about 19.3 wt. %, about 19.4 wt. %, about 19.5 wt. %, about 19.6 wt. %, about 19.7 wt. %, about 19.8 wt. %, about 19.9 wt. %, or about 20.0 wt. %.

The reinforcement phase may gradually increase from 0 wt. % TiC or TiB at the alloy layer up to 50 wt. % within an outer MMC layer. For example, the amount of TiC or TiB at the alloy layer may be about 0 wt. %, about 1 wt. %, about 2 wt. %, about 3 wt. %, about 4 wt. %, about 5 wt. %, about 6 wt. %, about 7 wt. %, about 8 wt. %, about 9 wt. %, about 10 wt. %, about 11 wt. %, about 12 wt. %, about 13 wt. %, about 14 wt. %, about 15 wt. %, about 16 wt. %, about 17 wt. %, about 18 wt. %, about 19 wt. %, about 20 wt. %, about 21 wt. %, about 22 wt. %, about 23 wt. %, about 24 wt. %, about 25 wt. %, about 26 wt. %, about 27 wt. %, about 28 wt. %, about 29 wt. %, about 30 wt. %, about 31 wt. %, about 32 wt. %, about 33 wt. %, about 34 wt. %, about 35 wt. %, about 36 wt. %, about 37 wt. %, about 38 wt. %, about 39 wt. %, about 40 wt. %, about 41 wt. %, about 42 wt. %, about 43 wt. %, about 44 wt. %, about 45 wt. %, about 46 wt. %, about 47 wt. %, about 48 wt. %, about 49 wt. %, or about 50 wt. %.

The laminate structure may provide improved antiballistic properties because the HIP process for bonding the layers reduces the porosity in each of the layers and in the laminate structure as a whole. The porosity of the laminate structure may be less than or equal to about 5%. For example the porosity may be less than or equal to about 4.9%, about 4.8%, about 4.7%, about 4.6%, about 4.5%, about 4.4%, about 4.3%, about 4.2%, about 4.1%, about 4.0%, about 3.9%, about 3.8%, about 3.7%, about 3.6%, about 3.5%, about 3.4%, about 3.3%, about 3.2%, about 3.1%, about 2.0%, about 1.9%, about 1.8%, about 1.7%, about 1.6%, about 1.5%, about 1.4%, about 1.3%, about 1.2%, about 1.1%, about 1.0%, about 0.9%, about 0.8%, about 0.7%, about 0.6%, about 0.5%, about 0.4%, about 0.3%, about 0.2%, or about 0.1%. In some embodiments, the porosity of the laminate structure may be less than or equal to 4%. In some embodiments, the porosity of the laminate structure may be less than or equal to 3%. In some embodiments, the porosity of the laminate structure may be less than or equal to 2%. In some embodiments, the porosity of the laminate structure may be less than or equal to 1%. In some embodiments, the porosity of the laminate structure may be less than or equal to 0.1%.

Furthermore, the porosity of the two or more MMC layers may decrease by at least 10% after applying HIP. For example, the porosity may decrease by at least about 10%, about 11%, about 12%, about 13%, about 14%, about 15%, about 16%, about 17%, about 18%, about 19%, about 20%, about 21%, about 22%, about 23%, about 24%, about 25%, about 26%, about 27%, about 28%, about 29%, about 30%, about 31%, about 32%, about 33%, about 34%, about 35%, about 36%, about 37%, about 38%, about 39%, or about 40%. The residual porosity of the laminate structure may be eliminated after applying HIP. Without being limited to any one theory, the combination of the BEPM processing and HIP leads to less porosity (e.g., elimination of residual porosity) in the final laminate structure than a laminate structure formed with either BEPM or HIP alone (e.g., some residual porosity). The residual porosity from the BEPM processing may be beneficial in the further HIP processing to produce the final laminate structure with minimal porosity. The pre-existing porosity prior to HIP provides the possibility for the matrix alloy to be easily plastically deformed, creating higher dislocation density and accelerating the diffusion of the elements: Ti, C, B. That forms better integration of reinforcement particles and better bonding of the layers. In some examples, the laminate structure may have improved mechanical and antiballistic protective characteristics as compared to a structure formed without applying HIP.

The two or more MMC layers of the laminate structure may have a hardness greater than about 500 HV. For example, the hardness may be greater than about 525 HV, about 550 HV, about 575 HV, about 600 HV, about 625 HV, about 650 HV, about 675 HV, about 700 HV, about 725 HV, about 750 HV, about 775 HV, or about 800 HV. In some embodiments, the hardness may be greater than 600 HV. In other embodiments, the hardness may be greater than 700 HV. In yet other embodiments, the hardness may be greater than 750 HV. In other embodiments, the hardness may be greater than 775 HV.

The laminate structure may be in the form of a plate, cylinder, washer, or any other substantially flat shape. Any sized plate, cylinder, or washer appropriate for military, automotive, or protective use is contemplated. In some instances, the length of the plate may be from about 9 cm to about 30 cm or greater. For example, the length of the plate may be any number from about 10 cm to about 29 cm, from about 11 cm to about 28 cm, from about 12 cm to about 27 cm, from about 13 cm to about 26 cm, from about 14 cm to about 25 cm, from about 15 cm to about 24 cm, from about 16 cm to about 23 cm, from about 17 cm to about 22 cm, or from about 18 cm to about 21 cm. The width of the plate may be from about 9 cm to about 30 cm or greater. For example, the width of the plate may be any number from about 10 cm to about 29 cm, from about 11 cm to about 28 cm, from about 12 cm to about 27 cm, from about 13 cm to about 26 cm, from about 14 cm to about 25 cm, from about 15 cm to about 24 cm, from about 16 cm to about 23 cm, from about 17 cm to about 22 cm, or from about 18 cm to about 21 cm. The thickness of the plate may be from about 1 cm to about 5 cm. For example, the thickness may be about 1.0 cm, about 1.5 cm, about 2 cm, about 2.5 cm, about 3 cm, about 3.5 cm, about 4 cm, about 4.5 cm, or about 5.0 cm.

Method of Manufacturing a Laminate Structure

The method of manufacturing the laminate structure described above includes fabricating a first MMC layer including a titanium alloy and 5 vol. % to 50 vol. % TiC or TiB using BEPM treatment followed by bonding an alloy layer including a titanium alloy and the first MMC layer by applying HIP, thereby forming the laminate structure.

The HIP step may be performed at a temperature just below the $\alpha$-$\beta$ phase transformation completion for the titanium alloy, e.g., about 800° C. to about 1000° C. The HIP step may be performed at any temperature from about 805° C. to about 995° C., from about 810° C. to about 990° C., from about 815° C. to about 985° C., from about 820° C. to about 980° C., from about 825° C. to about 975° C., from about 830° C. to about 970° C., from about 835° C. to about 965° C., from about 840° C. to about 960° C., from about 845° C. to about 955° C., from about 850° C. to about 950° C., from about 855° C. to about 945° C., from about 860° C. to about 940° C., from about 865° C. to about 935° C., from about 870° C. to about 930° C., from about 875° C. to about 925° C., from about 880° C. to about 920° C., or from about 885° C. to about 915° C.

The HIP step may be performed at a pressure of about 100 MPa to about 200 MPa. The pressure may be any pressure from about 110 MPa to about 190 MPa, from about 120 MPa to about 180 MPa, from about 130 MPa to about 170 MPa, or from about 140 MPa to about 160 MPa.

The HIP step may be performed for about 3 hours to about 5 hours. The HIP step may be performed for about 3 hours, about 3.1 hours, about 3.2 hours, about 3.3 hours, about 3.4 hours, about 3.5 hours, about 3.6 hours, about 3.7 hours, about 3.8 hours, about 3.9 hours, about 4 hours, about 4.1 hours, about 4.2 hours, about 4.3 hours, about 4.4 hours, about 4.5 hours, about 4.6 hours, about 4.7 hours, about 4.8 hours, about 4.9 hours, or about 5.0 hours. The duration of the HIP step may be determined based on the amount of reinforcement particles present in the one or more MMC layers. The more the reinforcement, the longer the HIP processing may be run. However, any range of processing times for the range of reinforcement is contemplated.

EXAMPLES

Introduction

Titanium alloys are important structural materials for numerous applications due to a unique complex of physical and mechanical properties. The engineering application of these alloys is primarily based on their high specific strength well-balanced with other mechanical characteristics. Titanium alloys are used in the biomedical, aerospace, automotive, and military products. In the latter case, titanium alloys are very desired materials for the armor elements fabrication. Layered structures for this application are shown as one of the best approaches to improving the protective performance of armor. Respectfully, it is very important to have high hardness value at the front surface of the armor element to stop the piercing action of the projectile and high ductility in its core to prevent the fragmentation of the armor.

Powder metallurgy (PM) is one of the best methods of making layered structures, which is not easy to achieve using more traditional titanium processing such as cast and wrought technology. Besides, it is very attractive due to its cost efficiency. It has been recently shown that the laminate structures of the alloy Ti-6Al-4V (wt. %) (Ti64) and metal matrix composites (MMC) based on this alloy can be made by relatively simple pressing and sintering Blended Elemental Powder Metallurgy (BEPM) using titanium hydride $TiH_2$ as a base powder with additions of Al—V master alloy. For the higher hardness composite layers, reinforcement particles of TiC or TiB can be added to the blend. Owing to the presence of such particles in the top layer of the laminate, the surface hardness can be increased from about 340 HV common for conventional Ti64 alloy, to about 400-430 HV when 20 vol. % of TiC particles is added to the composite. However, the core of special armor piercing bullet is made of reinforced steel with a hardness above 700 HV, therefore, effective protection against the piercing action of such projectile requires a corresponding hardness of the armor. A significant hardening effect can be achieved in titanium-based composites via high temperature solution treatment after sintering of the structure, which was explained by increasing the hard fraction content during high temperature aging and quenching. Though, it was discussed that the lack of complete structure densification prevents the material from reaching its ultimate performance. The most common ways of porosity reduction in PM-made metal parts usually involve a post processing of the structure using hot plastic deformation. Unfortunately, it is not effective on multilayer structures due to the mismatch in the plastic flow of different layers during hot plastic deformation of the laminate. However, when plastic deformation is applied isostatically, as it done in hot isostatic pressing, this difficulty can be overcome. This was experimentally confirmed for near-P titanium powder alloys. The combined effect of high temperature and pressure, which used in HIP could potentially eliminate the porosity as well as increase the content of the hard phase within the composite. Although the added treatment undoubtedly increases the cost of the entire process, its use can be justified by a significant improvement in the mechanical characteristics of the final products. In view of the above, the purpose of this study was to increase the hardness of composites on the base of titanium alloy Ti64 to improve their antiballistic protection by (i) adding a higher content of hard phases than was used before and (ii) reducing residual porosity. It was expected that for parts manufactured using BEPM, the goal could be achieved by further processing them using HIP.

Materials and Experimental Procedure

Six composite tiles on the base of the alloy Ti64 reinforced with different amounts of either TiC or TiB particles, were made using BEPM. Each individual tile was reinforced with 10, 20, or 40 (vol. %) of TiC or TiB particles. The 40 vol % TiC tile was expected to provide the highest hardness and planned for use as a front layer in the laminate. Two other tiles' compositions, 20 vol. % and 10 vol. % of TiC, were selected based on the optimal ratios for reinforcement between adjacent layers to optimize the mechanical properties of laminates. For structures with TiB, similar tiles' compositions, 40 vol. %, 20 vol. %, and 10 vol. % were taken to compare the effect of different hardening phase. All six powder blends were prepared using hydrogenated titanium ($TiH_2$) sponge crush (3.5 H (wt. %), particle size ≤100 μm) as the base powder instead of conventional titanium powder.

For making individual MMC tiles on the base of alloy Ti64, $TiH_2$ powder was blended with corresponding amounts of 60Al-40V (wt. %) master alloy powder (particle size ≤63 μm) and either TiC powder (1-30 μm) or $TiB_2$ powder (1-20 μm). In the latter case, $TiB_2$ was expected to be converted during vacuum sintering to monoboride following the reaction $TiB_2+Ti \rightarrow TiB$. The powder blends were then die-pressed at 150 MPa at room temperature to obtain 90×90×10 mm flat preforms. The preforms were sintered in the vacuum furnace at 1250° C. for 4 h and cooled with the furnace. All treatments provided titanium dehydrogenation, sintering and homogenization of powder compacts, formation of nearly dense and uniform matrix alloy Ti64 with specified amounts of reinforcement phase. Initial structure sampling for its examination was not possible in this study since the goal was ballistic examination of the bonded tiles and only posttest structure examination was conducted at full scale. However, initial structure of composites was studied in an additional prior experiment using small cylinder samples described below. The sintered MMC tiles were joined together using HIP to produce three-layered hybrid plates. Two different three-layer plates were made, one with TiC and the other with TiB. The reinforcement in adjacent layers of each triplet varied by 10 vol. %, 20 vol. %, and 40 vol. %. HIP was done at 900° C., 100 MPa for 3 hours. Tiles were placed in one prismatic can with the stainless-steel spacer to separate different plates in stack. Plate laminates after the HIP had some specific bulges of technological origin in the center of the sample, which were removed by spark erosion and polished for their ballistic test.

This study carried out an additional prior experiment, which was done using small-sized cylinder samples. Ten MMC samples, five with TiC and five with TiB particles with a volume fraction varied from 20 to 60 vol. % in 10% increments, were used to test samples densification in HIP treatment and to verify HIP processing parameters that could be used to make armor plates suitable for the ballistic test. Composite cylinders with an initial dimension 10×15 mm (diameter×length) were manufactured through the sintering using standard in this study BEPM protocol. This test made it possible to finalize the HIP parameters for the manufacture of the composite laminates suitable for ballistic examination. For the HIP processing cylinder samples were placed in one tubular can with the stainless-steel spacers to separate each sample. After the HIP cylinders were removed from the tubular can. For the SEM structure study about 1 mm thick layer was cut using diamond saw from one end of each cylinder and polished; this guaranteed a structure representing the bulk.

Structure of the materials was characterized using light optical microscopy (LOM), done with Olympus® IX70 microscope, and digital microscope (DM) VHX-6000. Polished samples for LOM were etched with Kroll reagent (2% HF, 3% $HNO_3$, 95% $H_2O$). Samples after ballistic tests, including fractured surfaces, were studied using scanning electron microscope (SEM) VEGA 3. The fraction of porosity of the samples was estimated as the pores area fraction measured using ImageJ software. Given the size of the tiles and considering the plates multilayered structure, their porosity measurement using a more accurate Archimedes method was not possible, and their representative sampling for this purpose was not acceptable due to need of their ballistic examination. However, preliminary measurements made on another set of samples with similar reinforcement (below 40 vol. %) content show good agreement between these two methods.

Figure 1B:
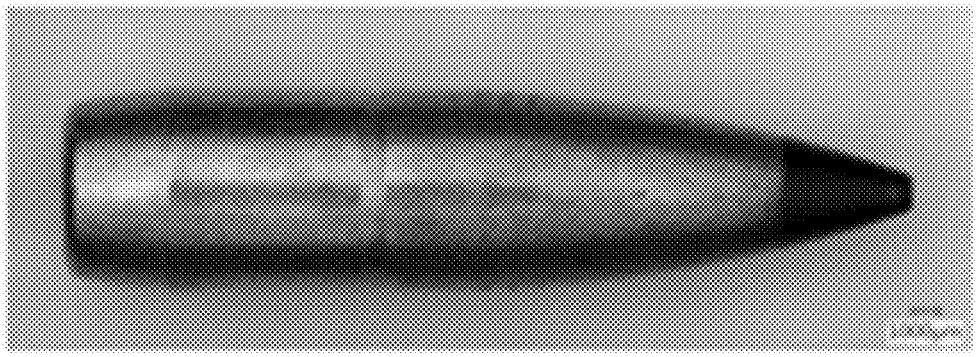
FIG. 1B is a pictorial representation of a general view of 7.62×51 mm AP bullet according to the present disclosure.
Figure 1C:
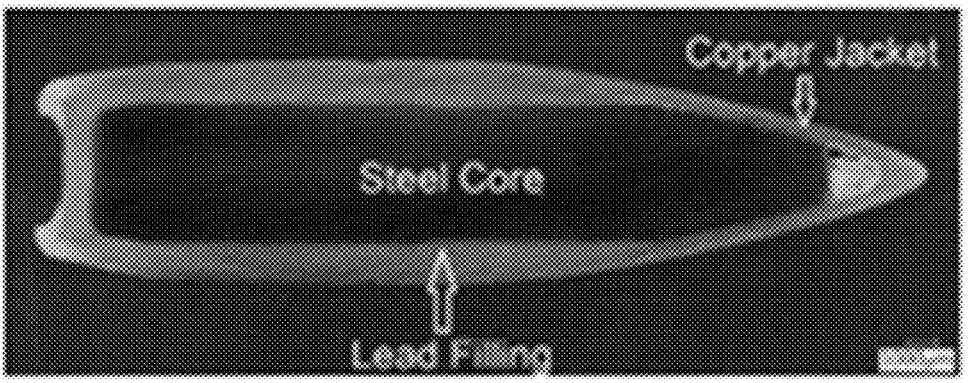
FIG. 1C is a pictorial representation of a bullet cut.

Ballistic tests were carried out using a stand shown in FIG. 1A in a ballistic test laboratory. 7.62×51 mm NATO ammunition was equipped with a flat-nose core AP projectile weighing 126.6 grains—i.e., 9.45 g (FIG. 1B), and contained a hard steel core with a blunt tip (FIG. 1C). A grain is a unit of measurement of mass, and in the troy weight, avoirdupois, and apothecaries' systems, equal to exactly 64.79891 milligrams. Rounds applied during investigations were produced by MESKO S. A., Poland. Some other important characteristics of used ammunition are listed in Table 1. In order to record the moment of projectile impact and its deformation and destruction, a high-speed camera was used with the resolution reduced to 256×256 dpi, the frame rate was around 130,000 frames/second. It is important to note that the core hardness of such a bullet is 870 HV, while the highest hardness value of titanium alloy, expected after the special hardening heat treatment, usually does not exceed 350-400 HV. This is the main reason for the relatively low ballistic resistance of titanium-based armor when it's compared to rolled homogeneous armor (RHA) steels, which is still considered as one of the most commonly used armor material.

TABLE 1

The main characteristics of the used cartridges.

| Type | Total weight, g | Core weight, g | Core diam., mm | Core nose angle, deg. | Core material | Core hardness, HV | Kinetic energy, J |
|---|---|---|---|---|---|---|---|
| 7.62 × 51 mm AP | 9.45 | 4.4 | 5.6 (rear) 5.4 (front) | 45 | Steel | 870 | >3500 |

Results

Microstructures of Materials after BEPM Fabrication and HIP Processing.

Figures 2A, 2B, 2C, 2D, 2E:
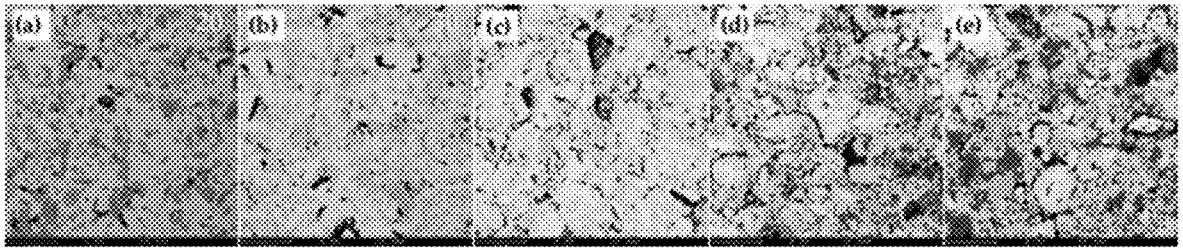
FIGS. 2A-E are SEM images of MMC with 20 vol. %, 30 vol. %, 40 vol. %, 50 vol. %, and 60 vol. % TiC before HIP treatment. All images are shown at the same magnification.
Figures 2F, 2G, 2H, 2I, 2J:
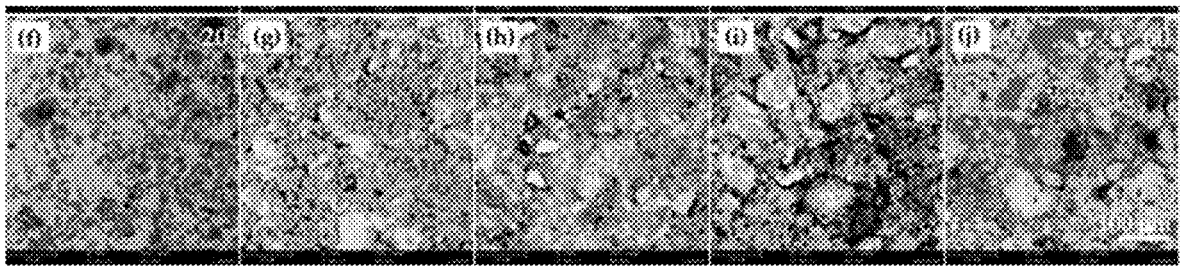
FIGS. 2F-J are SEM images of MMC with 20 vol. %, 30 vol. %, 40 vol. %, 50 vol. %, and 60 vol. % TiC after HIP treatment. All images are shown at the same magnification.
Figures 3A, 3B, 3C, 3D, 3E:
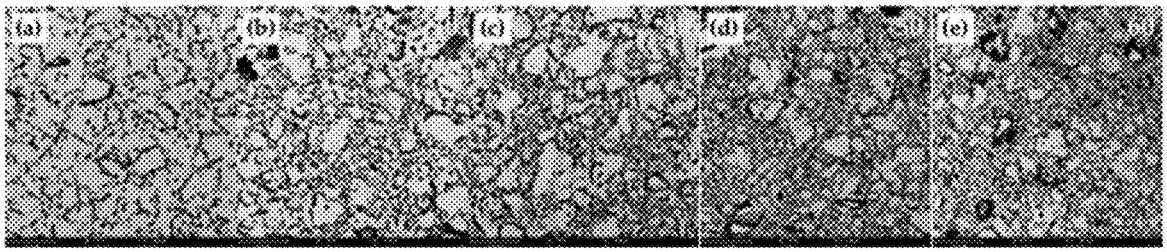
FIGS. 3A-E are SEM images of MMC with 20 vol. %, 30 vol. %, 40 vol. %, 50 vol. %, and 60 vol. % TiB before HIP treatment. All images are shown at the same magnification.
Figures 3F, 3G, 3H, 3I, 3J:
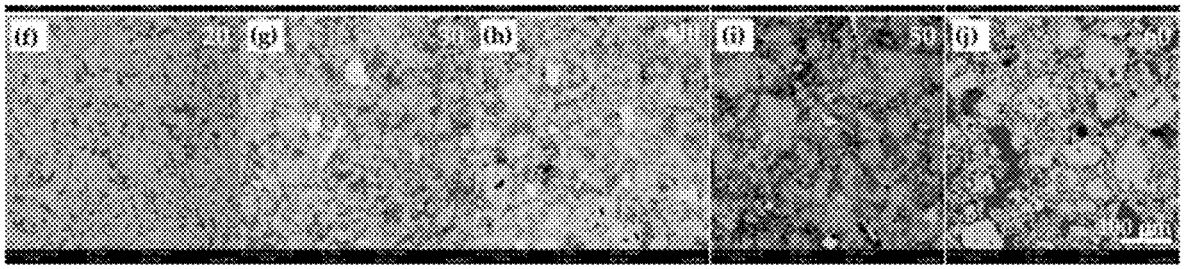
FIGS. 3F-J are SEM images of MMC with 20 vol. %, 30 vol. %, 40 vol. %, 50 vol. %, and 60 vol. % TiB after HIP treatment. All images are shown at the same magnification.

Microstructure of the cylinder samples after BEPM and HIP made in prior experiment are shown in FIG. 2 for TiC and FIG. 3 for TiB composites respectfully. All images in FIGS. 2 & 3 are shown in the same magnification. The fraction of porosity measured on these samples before and after the HIP is listed in the Table 2. As can be seen, HIP was very effective for porosity reduction in composites, especially when reinforcement fraction was not higher than 40 vol. %. This is true for both types of composites with TiC and TiB. When the particle content was 40 vol. % and below, 10-25 times porosity reduction of TiB composites was achieved compared to only 2-4 times reduction in TiC composites under the similar conditions. When the particle content exceeds 40%, the effect of HIP treatment was not as obvious, and the results listed for 60 vol. % composites may seem really strange at first glance, suggesting no change in porosity for the TiB composite and its increase for the TiC composite. Needless to say, the latter result must be treated with a high degree of skepticism and require some clarification to understand it correctly. Closer up observation of the sample in FIGS. 21 &J indicated that some parts of the structure were lost during sample preparation, so the measured "absence of material" at the surface does not represent the porosity per se which exists in bulk; it rather reflects the structure that become very fragile. More detailed images supporting this argument are presented in FIGS. 15A-D. However, the Ti64 alloy composites with 40 vol. % of TiC after BEPM fabrication can form continuously reinforced structures that do not have enough ductile phase regions for the composite to be successfully plastically deformed. In other words, effective plastic deformation of the matrix is prevented by a rigid and continuous framework made of a very hard and brittle reinforcement phase. It is difficult to expect that a continuously reinforced composite can be well deformed during HIP to change porosity. On the other hand, with the lacking of a plastic phase, the pressure applied during HIP can damage the fragile structural framework. Summarizing these results, composites made using BEPM with TiC and TiB particles below 40 vol. % can be effectively densified by applying further HIP treatment. It is worth noting that when the porosity of titanium alloys is below 2%, their performance is not affected strongly. In present study, the porosity after HIP was exceeding the threshold value when the particle content was higher than 30%. It is also accepted that when the porosity slightly exceeds the 2% threshold, the reduction in mechanical properties is still not abrupt.

However, recently published data on high temperature aging of TiC composites at 1000° C. show that the hardness rate increase in the range of 30-40 vol. % of particles content is almost twice as fast as when the content is below 30 vol. %. Thus, it was expected that even though the porosity was slightly above the threshold, the benefit of increasing hardness would overcome the disadvantage of slightly increased porosity, and for this reason the use of 40% composites were accepted in the present study. Based on this evaluation the composites with reinforcement content 40% and below were selected for further HIP experiment to fabricate the plates suitable for the ballistic test.

TABLE 2

Porosity (%) in MMC with TiC and TiB before and after the HIP processing.

| | Ti64 + X % TiC | | | | | Ti64 + X % TiB | | | | |
|---|---|---|---|---|---|---|---|---|---|---|
| X % | 20 | 30 | 40 | 50 | 60 | 20 | 30 | 40 | 50 | 60 |
| before | 4.6 | 7.5 | 16.5 | 23.1 | 25.5 | 25.1 | 27.9 | 28.5 | 34.5 | 35.5 |
| after | 1.2 | 2.1 | 5.4 | 16.6 | 45.2 | 0.1 | 1.0 | 3.4 | 15.5 | 35.3 |

The detailed microstructure of the plates after the sintering is shown in FIG. 4. The structure is a uniform lamellar $\alpha+\beta$, typical for sintered Ti64 alloy with some inclusions of reinforcing phase particles. Sintering results in complete dehydrogenation of the starting $TiH_2$ powder and formation of a titanium-base matrix where aluminum and vanadium are uniformly distributed. Current results show that depending on type and content of reinforcing particles, the fraction of residual pores can be relatively high.

Figure 4A:
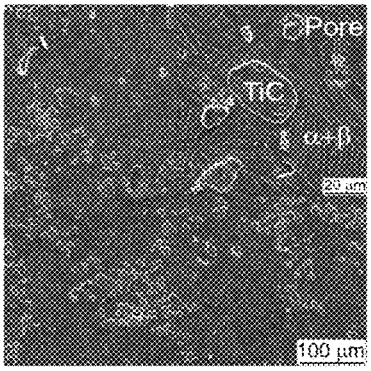
FIGS. 4A-4C are SEM images collected using secondary electrons (SE) showing microstructure of as-sintered MMC reinforced with 10 vol. %, 20 vol. %, and 40 vol. % TiC particles respectively.
Figure 4B:
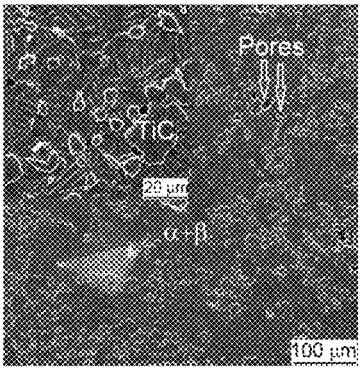
Figure 4C:
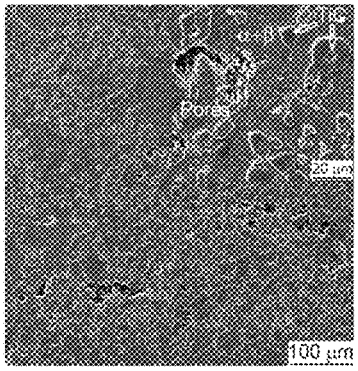
Figure 4D:
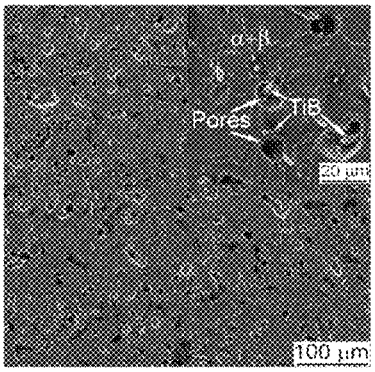
FIGS. 4D-4F are SEM images showing microstructure of as-sintered MMC reinforced with 10 vol. %, 20 vol. %, and 40 vol. % TiB particles respectively.
Figure 4E:
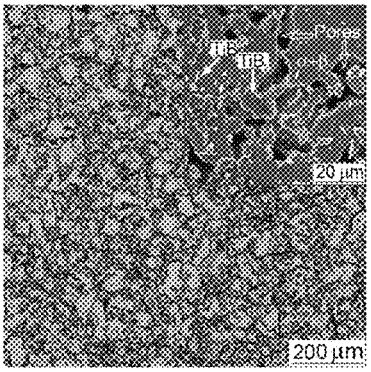

The TiC particles are nearly equiaxed but unevenly distributed in MMC (FIGS. 4A-C). This is due to the tendency for TiC particles to form conglomerates at blending stage, and it is commonly observed. As the amount of TiC particles increases, their non-uniform distribution becomes more apparent. In addition, the number and size of pores also increases. The structure of MMC reinforced with TiB particles is somewhat different (FIGS. 4D-E). Despite the similar appearance of the matrix alloy showing a fine-grained $\alpha+\beta$ microstructure, the reinforcing particles are more evenly distributed. The needle-like TiB inclusions were formed during sintering as a result of the reaction $TiB_2+Ti=2TiB$. When $TiB_2$ content was 10% the needles are uniformly distributed over the matrix (FIG. 4D). The fraction of residual pores is noticeably greater than in composite with similar amount of TiC.

Figure 4F:
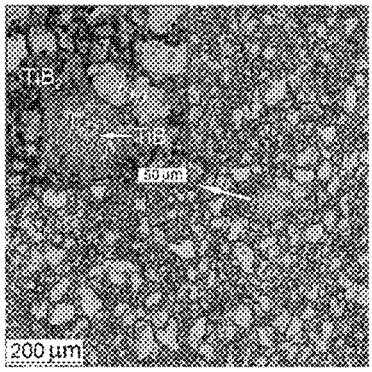

Most likely this is a result of additional porosity formation via the Kirkendall effect during the transformation of $TiB_2$ particles into TiB. When the $TiB_2$ content increases to 20%, it becomes apparent that not all particles are converted into TiB and exist not transformed together with the newly formed TiB needles (FIG. 4E). Besides, the fraction of residual pores increases with increasing boride content (FIG. 2E). This trend intensifies when the boride content exceeds 40% (FIG. 2F). The ratio between non-transformed $TiB_2$ and transformed TiB phases increases in favor of the latter case. In addition, the number and size of the $\alpha+\beta$ matrix alloy regions continue to decrease. Although the pore fraction increases significantly, the pores are fairly evenly distributed (FIG. 4F).

The structure of all composites changed significantly after the tiles were HIP bonded into three-layer plates. The interfaces between layers are well consolidated with no visible pores. Most likely the load applied during the HIP resulted in plastic deformation promoting additional dislocations formation, which facilitate the diffusion and better bonding of layers.

The structure of TiC composites after the HIP is shown in FIG. 5. The changes take place for the shape, size, and also the chemical composition of carbide particles with the possibility of formation of diffusion zones enriched with carbon (FIGS. 5A-C). As a result of 3-hour HIP at 900° C. and applied load, the TiC particles and their aggregates, grow into larger ones, and their outlines become more rounded (FIGS. 5A-C). The observed changes are a result of carbon diffusion from TiC into the alloy. As a result of such diffusion, TiC can be partially transformed into $Ti_2C$ which is an equilibrium phase at elevated temperatures. This causes an increase of reinforcement phase volume fraction. As can be seen, some larger carbide particles systematically exhibit darker tone in their core, whereas the outer regions are much brighter. This indicates heterogeneity in the particle composition and it is confirmed with the EDS chemical analysis (FIGS. 5D & E). The composition of carbide is close to the stoichiometric TiC in the particle core, but it is carbon-depleted in the outer regions of the particle (points 1 and 2 in FIG. 5E and Table 3). Brighter layers adjacent to carbon-depleted regions of particles also contain a marked amount of aluminum, which is slightly higher than in surrounding matrix alloy (points 3 and 4 in FIG. 5E and Table 3). This is a likely result of the formation of the ternary phase $Ti_3AlC$. Chemical composition of ternary phase is quite different from the two-phase $\alpha+\beta$ Ti64 alloy (point 5 in FIG. 5E and in Table 3), primarily due to high amount of carbon, and aluminum.

TABLE 3

Figure 5A:
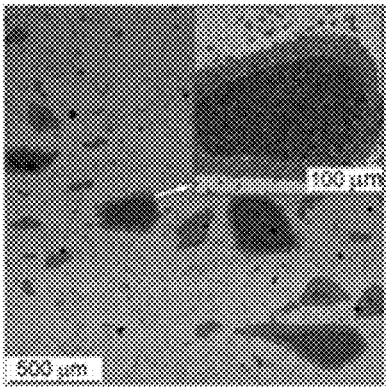
FIGS. 5A-C are SEM images collected using BSE of a microstructure and composition of layered hybrid plate reinforced with TiC after the HIP with 10 vol. %, 20 vol. %, and 40 vol. % MMC layers.
Figure 5B:
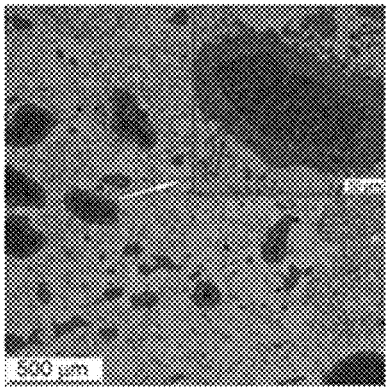
Figure 5C:
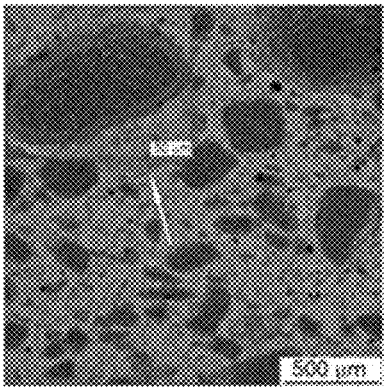
Figure 5D:
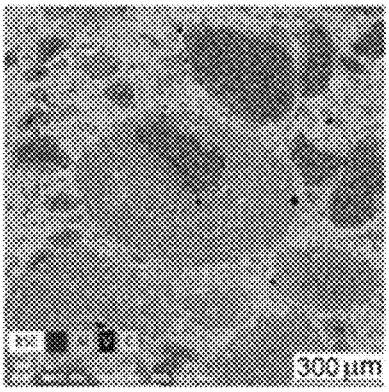
FIGS. 5D-E are SEM images collected using BSE showing EDS chemical analysis of laminates with 40 vol. % layer TiC MMC layers.
Figure 5E:
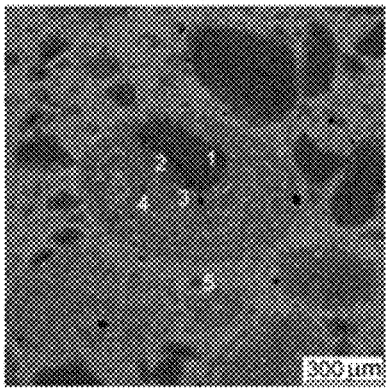

EDS spot analysis in points shown in FIG. 5E.

| | Element content, wt./at. % | | | | |
|---|---|---|---|---|---|
| Point | Ti | C | Al | V | Fe |
| 1 | 88.5/66.1 | 11.3/33.6 | 0.2/0.3 | 00.0 | 00.0 |
| 2 | 91.2/72.5 | 8.6/27.2 | 0.2/0.3 | 00.0 | 00.0 |
| 3 (grey) | 82.7/67.5 | 4.1/13.3 | 13.3/19.2 | 00.0 | 00.0 |
| 4 (white) | 71.6/68.5 | 2.6/10.1 | 4.9/8.3 | 10.1/9.1 | 2.5/2.1 |
| 5 | 85.4/78.8 | 1.4/5.0 | 7.0/11.5 | 4.4/3.8 | 0.9/0.7 |

Figure 5F:
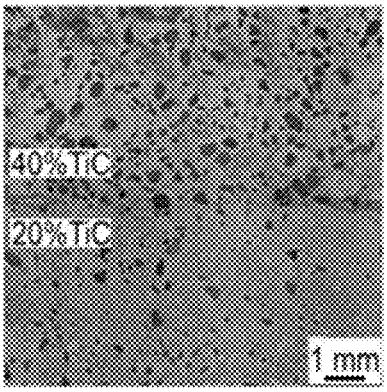
FIG. 5F is a light optical microscope (LOM) image showing the boundary between layers containing 20 vol % and 40 vol % TiC, indicated by arrows.

Using HIP greatly modified the structure and chemistry of the composites. It increases the volume fraction of the strengthening phase by partially converting it from TiC into $Ti_2C$ by using titanium from the matrix; in other words, it increases the fraction of the harder phase at the expense of the softer one. Another important result is formation of a new interface between the carbide particles and surrounding matrix alloy, which results of chemical reaction between the reinforcement phase and the matrix alloy. All of this is possible due to diffusion mobility of the elements involved, additionally activated by used high temperature. Moreover, diffusion of carbon continues further into the already-formed alloy matrix from the initial powder matrix, which can be identified by the presence of vanadium, which has the lowest diffusion mobility in titanium. Finally, another very important consequence of HIP is significant reduction of porosity in all composite layers and their tight bonding (FIG. 5F). Without a doubt, all these structural changes should improve the mechanical properties of the laminates.

Figure 6A:
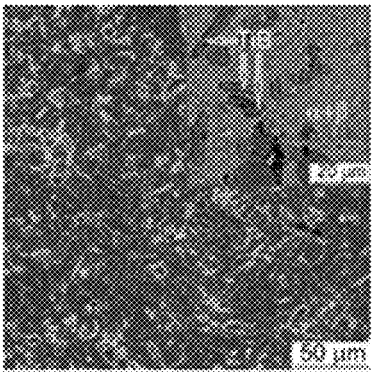
FIGS. 6A-C are an SEM image collected using SE of a microstructure and composition of layered hybrid plate reinforced with TiB after the HIP with 10 vol. %, 20 vol. %, and 40 vol. % TiB MMC layers. The corner magnified image was collected using BSE.
Figure 6B:
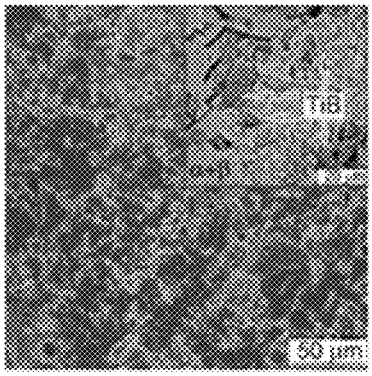
Figure 6C:
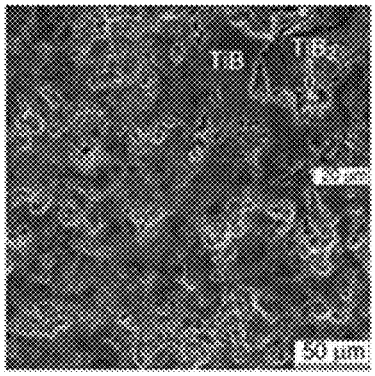
Figure 6D:
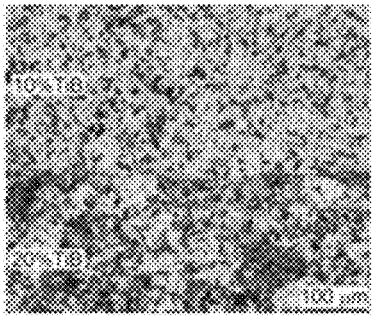
FIGS. 6D-E are digital microscope images of boundaries between layers between 10 vol. % TiB and 20 vol. % TiB and between 20 vol. % TiB and 40 vol. % TiB respectively. Arrows in (d, e) indicate boundaries between layers.
Figure 6E:
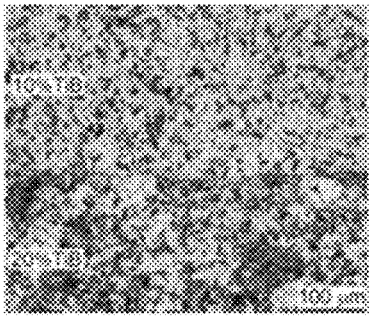

Composites reinforced with TiB still show some residual porosity after the HIP (FIGS. 6A-C), but its fraction was drastically reduced after the treatment. The porosity measured in 10% TiB layer was below 1%, and the particles did not change their dispersion character (compare FIGS. 6A & 4D). In the 20% TiB layer, the total pore fraction also decreased significantly after HIP, while the transformation of $TiB_2$ into TiB was essentially complete (compare FIGS. 6B & 4E). In addition, in the 20% TiB layer, majority of particles after HIP exhibit rather plate morphology than needle. The 40% TiB layer differed from 10 and 20% layers by the presence of some of $TiB_2$ particles still not transformed into TiB (FIG. 6C). It should be noted that the composite alloy matrix cannot be identified as a two-phase $\alpha+\beta$ structure. Most likely, the matrix alloy is titanium depleted, since a significant amount of it was reacted to convert $TiB_2$ into TiB. This inevitably makes the alloy enriched with alloying elements to a level that provides formation of relatively small inclusions of a high-alloyed P-phase. Interfaces between layers of TiB laminates (FIGS. 6D & 6E) appear more defective, less consolidated and not as smooth as in TiC structures (compare with FIG. 5F). The features of phase and structural transformations in MMC hardened with TiB occurring under HIP are quite complex and diverse, so that a separate work will be performed for their detailed description.

TABLE 4

Hardness values of TiC and TiB composite layers after the HIP.

| N | Vol. % | Hardness, HV | |
|---|---|---|---|
| | | Matrix | Carbides |
| | | TiC composites | |
| 1 | 10 | 422 ± 7 | >680 |
| 2 | 20 | 441 ± 24 | >850 |
| 3 | 40 | 789 ± 230 | 1049 ± 92 |
| | | TiB composites (ave.) | |
| 4 | 10 | 417 ± 2 | |
| 5 | 20 | 480 ± 15 | |
| 6 | 40 | 683 ± 32 | |

Figure 7A:
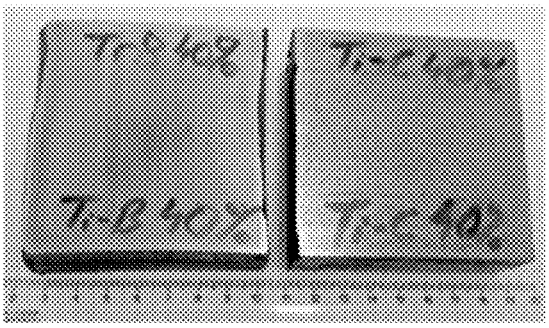
FIGS. 7A-B are photographic images of triple layer MMC hybrid plates reinforced with TiB and TiC after HIP.
Figure 7B:
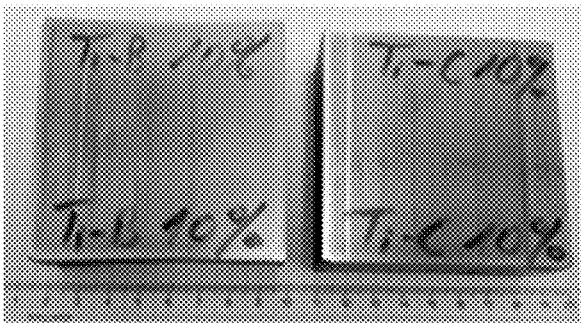
Figure 8A:
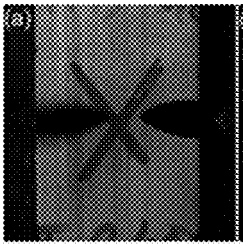
FIGS. 8A-J are images showing frames from high-speed video of ballistic test of three-layer TiB MMC plate performed with 7.62AP ammunition. The shot was fired into the 40 vol. % TiB side. The used frame rate was around 130,000 frames per second; the entire projectile impact was recorded in only on 10 frames.
Figure 8B:
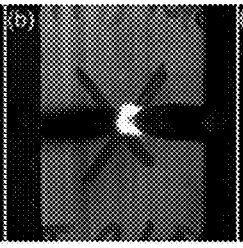
Figure 8C:
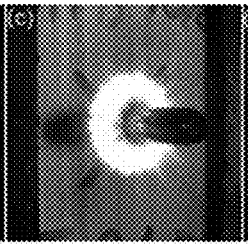
Figure 8D:
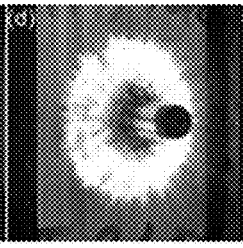
Figure 8E:
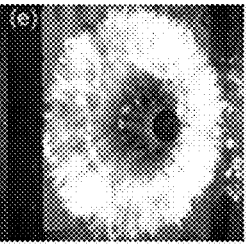
Figure 8F:
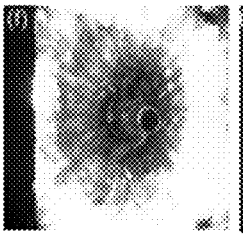
Figure 8G:
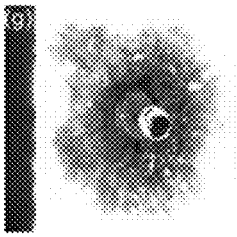
Figure 8H:
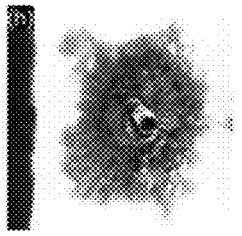
Figure 8I:
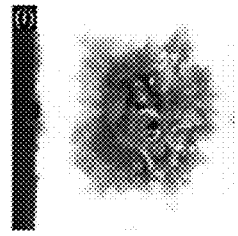
Figure 8J:
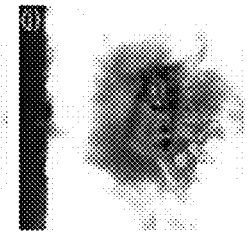

Three-layer plates joined using HIP were machined and polished from both sides (FIG. 7). The HV hardness measured in each triplet layer separately is shown in Table 4. Due to the relatively large size of the carbides, it was possible to measure hardness distinctly in the reinforcing particles and matrix alloy. This was not possible in TiB composites due to the higher particle dispersion, so only the average hardness of the layers was measured.

Ballistic Tests

Each layered plate was tested with two shots. The first shot was always fired to the side with 40% composite layer, and the second shot was always fired into the opposite, 10% composite layer. Images in FIG. 8 shows a sequence of frames taken at the same interval from the test recorded with a high-speed camera. The supplement video (S2) was taken during the first shot, fired at TiB laminate. As one can see, the bullet literally completely disappeared on impact. Significant fraction of the bullet energy is converted into flash and fire upon its contact with the armor plate surface. It can also be seen that the destruction of the high strength steel core (FIG. 8G-1) occurs after the destruction of the copper jacket of the projectile (FIG. 8D-F), which is a typical effect.

Figure 9A:
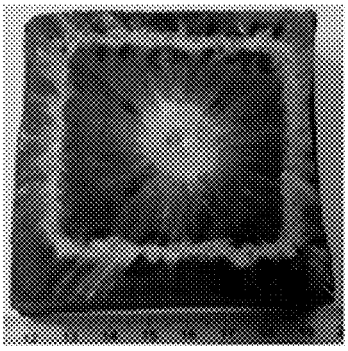
FIGS. 9A-D are LOM images of three-layer hybrid plate with TiB after ballistic test. View of the 40 vol. % composite side after the first shot fired that way (A); same side after the second shot fired from the opposite, 10 vol. % TiB side (B); 10% TiB side after second shot (C); cross section of the plate showing all three layers after the second shot (D). Crack configuration on both surfaces (B, C) and through layers (D) after the second shot.
Figure 9B:
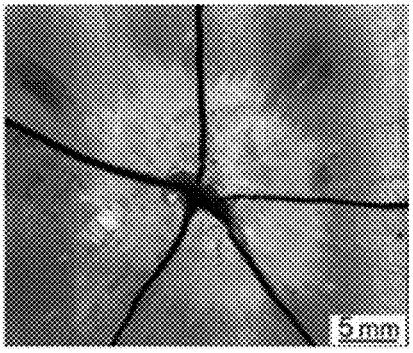
Figure 9C:
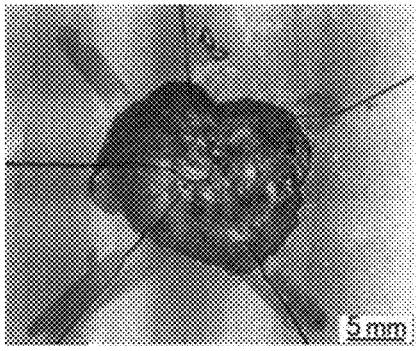
Figure 9D:
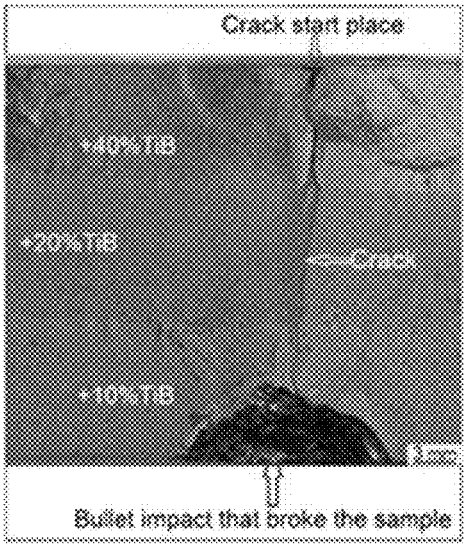
Figure 10A:
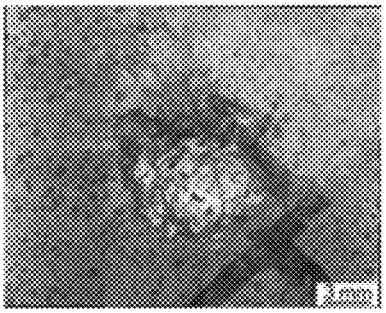
FIGS. 10A-D are LOM images of the surface of three-layer MMC plate with a bullet dent made on the 40 vol. % TiC side after firing on this side (A); the same place after the second shot, which was made on the opposite side, the 10 vol. % TiC layer (B); the bullet dent on the 10 vol. % side after second shot (C), and crack propagation on the side surface of three-layered sample after the second shot (D).
Figure 10B:
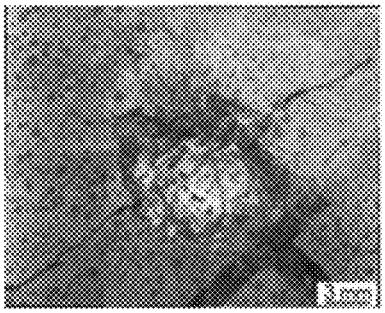
Figure 10C:
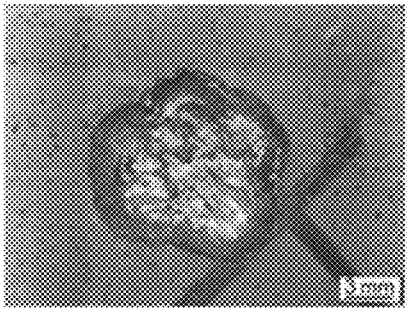
Figure 10D:
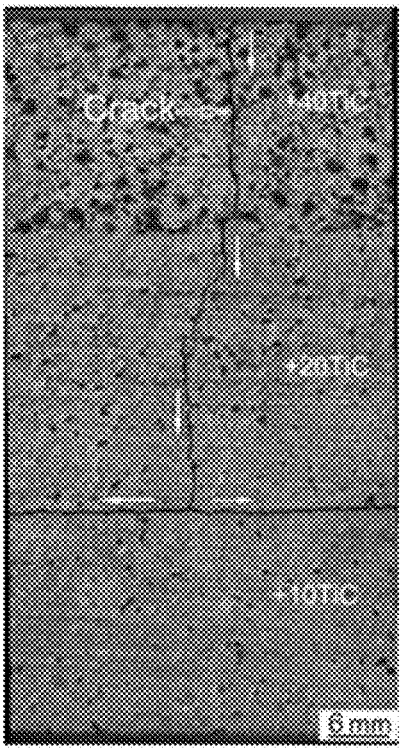

The first shot practically did not cause any destruction to the plate. The vast majority of debris and crushed pieces observed during the shot are a result of a disintegrated bullet. This was confirmed assessing the location of the bullet impact after the shot. A small crater slightly larger than 3 mm in diameter and up to 1 mm in depth was the only damage observed (FIG. 9A). The second shot fired at the opposite side, made a significant distraction to the plate (FIG. 9B). It created five radial cracks, starting at the bullet strike point and propagating to the edges of the sample. The cracks were throughout the entire plate thickness. The size of the crater after the second shot, was much larger, exceeding 20 mm in diameter and 6 mm in depth (FIGS. 9C-D). As can be seen in the first shot at the TiC laminate plate, it made a crater 6-8 mm in diameter and about 3 mm deep. A significantly larger crater with a diameter of about 20 mm and a depth of 6 mm was made after the second shot to the opposite side of the plate (FIGS. 10A and 10C). In this test, the plate was also broken only after the second shot and the crack was likewise initiated in the crater made after the first shot (FIG. 10B). However, in the TiC plate, the shape of the crack was significantly different from that formed in the TiB laminate. It deviates slightly more on individual larger TiC particles and at the interface between the 40% and 20% layers. Besides, the crack changes direction by 90° and spreads along the interface between 20% and 10% layers (FIG. 10D).

The differences in damage on opposite sides of the laminated plate with TiB after the first and the second shots are difficult to explain only by comparing the hardness values (N 4, and N 6 in Table 4), especially when compared to similar results obtained on TiC laminate (FIG. 10). This three-layer plate with carbides, having fairly close values of matrix hardness and even higher hardness of TiC particles in comparison with the total hardness of layers with TiB (compare N 1, N 2, and N 3 against N 4, N 5, and N 6, respectively, in Table 4), but is characterized by essentially a bigger crater after the first shot (compare FIGS. 9A & 10A).

Thus, comparing the results for both plates after the second firing, it can be concluded that the craters' parameters are quite close, as well as the hardness of the matrix of the layer reinforced with TiC and average hardness of the layer reinforced by TiB are rather close showing (422±7 HV) and (417±2 HV) correspondingly. This suggests that with given a combination of $\alpha+\beta$ matrix of Ti64 alloy and presence of 10% of strengthening particles, both materials behave similarly when fired with given bullet types, regardless of the nature/type of the particles.

The fracture surface near the dent from the shot into the 10% TiB layer and details of microstructure are shown in FIG. 11. A general view of the dent in (a) shows a smooth bell-shaped crater. The initial minor cracks do not destroy the entire plate; in contrast they extend at some depth of the layer creating the stress concentration from the first shot. The direction of its propagation is indicated by red arrows, and the depth of advance is marked by a dotted line. Various locations on the crater rim are marked by with letters A-F in (a) and their details are shown in (b-g). The images show that the nature of the fracture is virtually the same at all sites. The fracture shows ductile dimples and small rounded inclusions, which are visible in the inset in FIG. 11D. The melt of lead from the bullet filling can be seen in larger (FIGS. 11B, E, F) and smaller cracks as small drops.

Figure 11A:
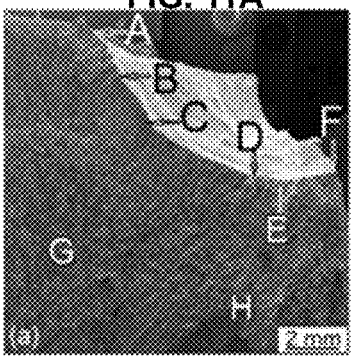
FIGS. 11A-J are SEM images showing the general view (A) and details (B-G, I, & J) of the area near the edge of crater, and microstructure (H) in 10 vol. % TiB layer after the second shot into the plate. Images A-G, I, & J were collected using SE and image H was collected using BSE.
Figure 11B:
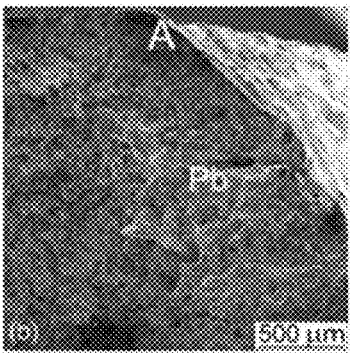
Figure 11C:
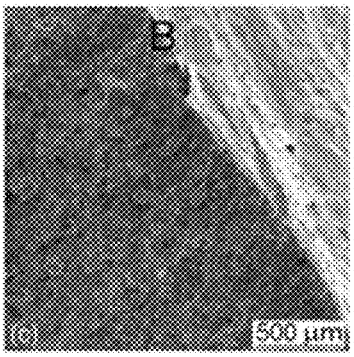
Figure 11D:
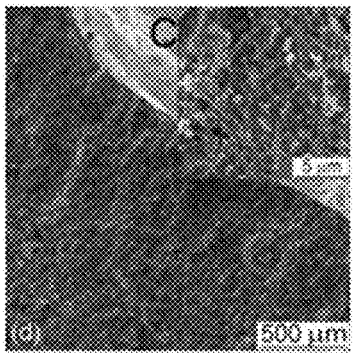
Figure 11E:
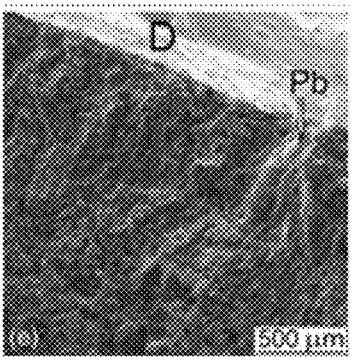
Figure 11F:
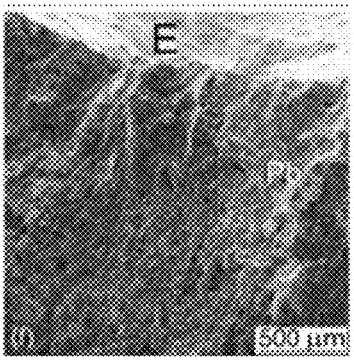
Figure 11G:
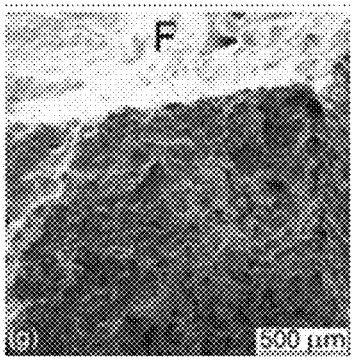
Figure 11H:
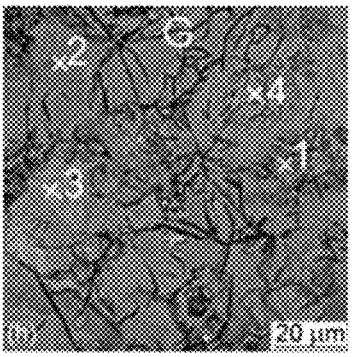
Figure 11I:
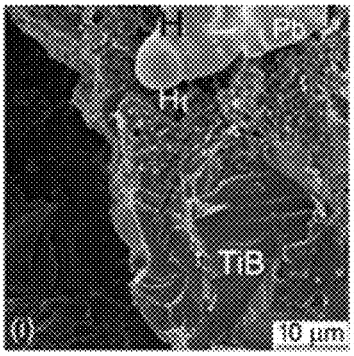
Figure 11J:
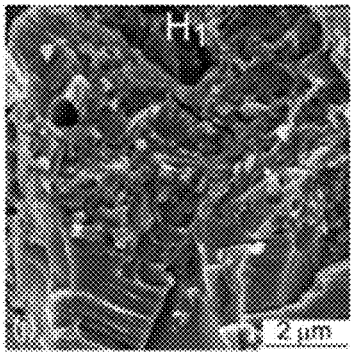

A thin section cut through the depth of the sample at a fairly significant distance from the crater, at least 8 mm from the fracture (Zone G in FIG. 11A), shows many small, randomly oriented cracks (FIG. 11H). There is a brittle micro-cleavages area observed directly below the center of the crater (Zone H in FIG. 11A), made by bullet impact near larger boride particles and their aggregates (FIGS. 111 & J). The evaluation of structure supported by the EDS chemical analysis measurements, indicate that both the residual $TiB_2$ (point 1 in FIG. 11H and N 1 in Table 5) and the newly formed TiB (point 4 and #4, ibid.) particles are extensively cracked. At the same time, sections #2 and #3 (ibid.), which are microvolumes of the Ti64 alloy saturated with boron, crack mainly along their boundaries, apparently because it is the boundaries that are characterized by lower plasticity.

However, since pure titanium is not being used, but an alloy containing also Al, V, and Fe, which was also subjected to HIP, it is possible that it was still a supersaturated solid solution.

Figure 12A:
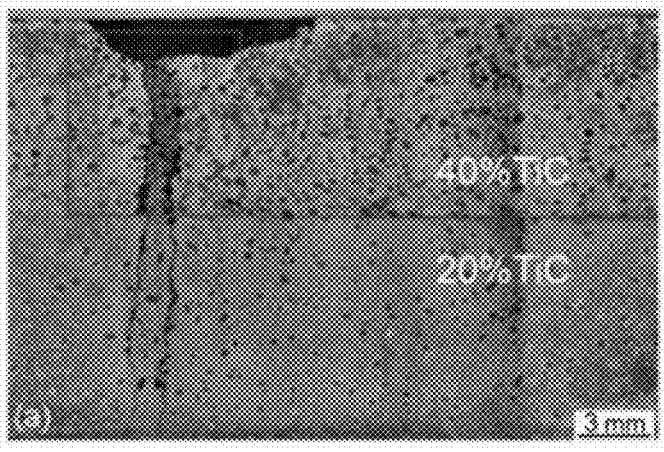
FIGS. 12A-B are images showing details of the microstructure in the vicinity of the crater from the first shot and the crack caused by it in the sample with TiC. Red arrows indicate cracks, blue—boundary between layers containing 40 vol. % and 20 vol. % of TiC.
Figure 12B:
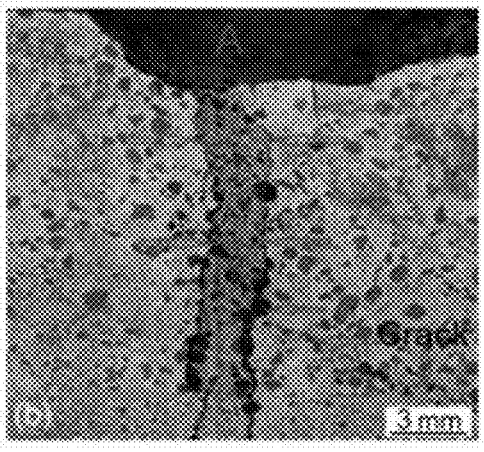

When comparing the cross sections of the two different plates, one with TiB and another with TiC shown in FIG. 9 and FIG. 10, it can be seen that the TiB composite structure exhibits a more brittle character and looks more like ceramic. This is likely due to the more uniform distribution of TiB particles in the matrix alloy compared to TiC composite. Less uniformly distributed TiC particles leave larger regions of the matrix alloy that locally exhibit higher plasticity. TiB hybrid structures do not have such regions and behave more like uniform ceramics that are unable to stop or heal a crack when it starts. Whereas the existence of large alloy regions in TiC composites leaves room for plastic mechanisms to be involved, resulting in effective retardation or possibly complete arrest of the crack. FIG. 10 shows 40% and 20% layers of TiC laminate after two shots. The crater in the 40% layer formed after the first shot into this layer, but the crack appeared only after the second shot into the opposite side, in the 10% layer (not shown in this image). The crack as it grows deviates from straight-line propagation on both at the boundary between layers (FIG. 12A) and on individual large TiC particles (FIG. 12B). Separately, it should be noted that the image clearly shows the presence of two parallel cracks, which are most likely the result of a fracture of a tubular shape, if presented in a 3D perspective. The distance between these two cracks or the diameter of the tube in 3D consideration, is close to 1.2 mm, which correlate well with the diameter of the hard steel core blunt tip of the AP bullet shown in FIG. 3C. This suggests that the observed specific shape of the damage is a result of the impact of steel core blunt bullet part. It confirms that studied hybrids resists well the impact of a projectile designed specifically to break through a plug-in armor material.

This type of structure damage is well consistent with the test results reported on relatively softer materials that used the same armor-piercing bullets. For example, during ballistic testing of rolled plate made of a conventional alloy Ti64 10-14 mm thick, the same type AP bullets made a similar plug. Unlike conventional Ti64 alloy, MMC based laminate plates may have different damage patterns when the blunt core bullet completely disintegrates (as with the TiB laminate shown in FIG. 8) or can cause the above-mentioned plug-shaped crack to form, which is predetermined by the interplay of hardness and plasticity of the material.

DISCUSSION

A general scheme describing the behavior of the studied three-layers MMC plates produced using BEPM combined with HIP can be proposed by summing the above results. The first shot fired into the layer, reinforced with 40% of hard particles, forms a relatively small crater and, naturally, an adjacent zone of accumulated stresses (FIG. 13A). Most likely, the area of accumulated internal stresses and probable microcracks spreads in a complex pattern over some considerable distance. The second shot fired into the opposite side of the plate, reinforced with 10% of hard particles, forms a larger crater (FIG. 13B) due to the lower hardness of this layer since it has a smaller number of hard particles. However, as a result of many factors, strong bending forces arise during the second shot, which in some way interact with the stress fields accumulated from the first shot. Some structural consequences of this interaction are different for composites reinforced with TiC and TiB, but in both, the craters formed after the first shot and adjacent region act as stress concentrator to initiate the cracks. In a 3-layer laminate with TiC, the crack nucleates near the crater in a 40% layer and propagates towards the boundary with a 20% layer adjacent to it, while deviating on individual TiC particles (FIG. 13C). Having reached the boundary between the layers, it also deviates somewhat, passes through the second layer in a similar way to the first and, having reached the boundary with the 3rd layer (10% TiC), changes its direction by 90°. In this case, the crack is formed in the vertical plane (perpendicular to the layers) for only 40% and 20% of TiC layers (FIG. 10B), and at the 3rd layer containing 10% TIC, after the crack direction is rotated 90°, it propagates along the boundary between 20% and 10% of TiC layers (FIG. 10D).

In the case of a similar double-shot ballistic test on opposite sides of the layered hybrid plates strengthened by TiB particles, both nucleation and crack propagation are noticeably different from TiC hybrids. Even a very small crater that appeared after the first shot A (FIG. 13A) also effectively acts as a stress concentrator and initiates cracks under the action of bending forces D arising from the second impact (FIG. 13D). However, unlike the case of TiC laminate, the result of such double-shot test is not a single crack formation, but 5 cracks radiating from the center of the crater formed after the first shot, C1 (FIG. 9B). In addition, all these cracks spread across all 3-layers, only slightly deviating from the rectilinear direction, mainly at the boundaries between the layers.

Figure 14:
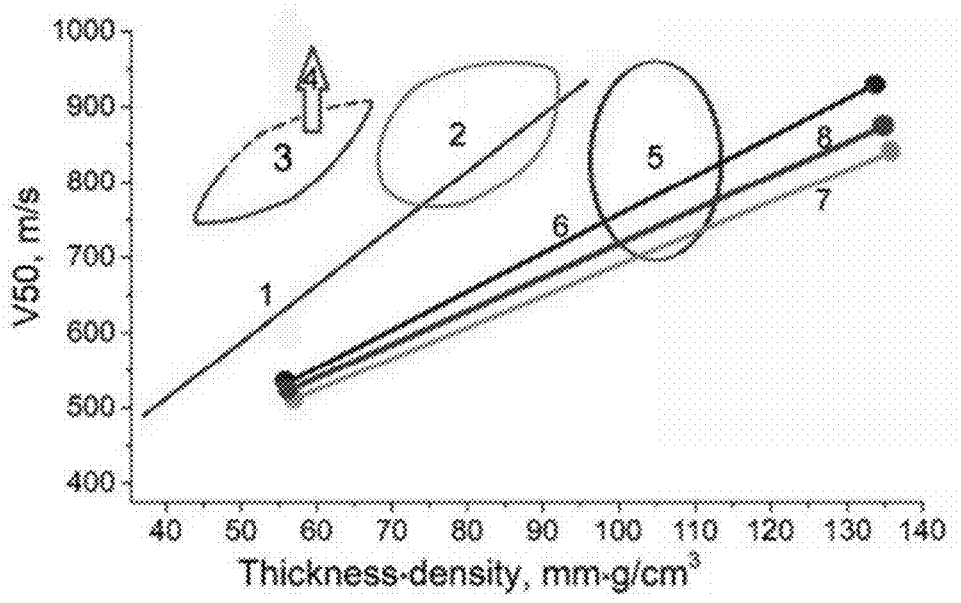
FIG. 14 is a graphical representation of the results of ballistic test V50 vs. thickness×material density reported for: (1)—various commercial rolled Ti-alloys; (2) 3D printed uniform Ti64; (3) BEPM made Ti64/composite laminates reinforced with TiC or TiB [7]; (4) arrow indicates on prospective V50 values for Ti64 composite laminates in present study (BEPM+HIP); (5) and (6) RHA steel; (7)—aluminum 5083AL alloy; (8)—magnesium AZ31 B alloy.
Figure 15A:
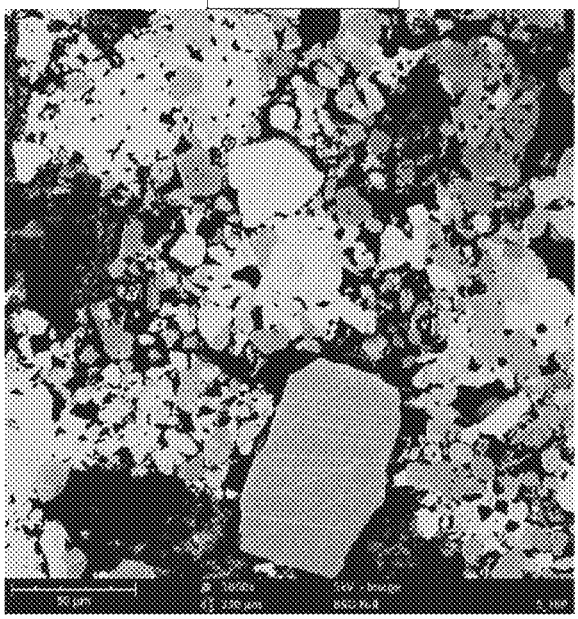
FIGS. 15A-D are images of MMC with 60% of TiC (A, B) and TiB (C, D), before (A, C) and after (B, D) the HIP treatment.
Figure 15B:
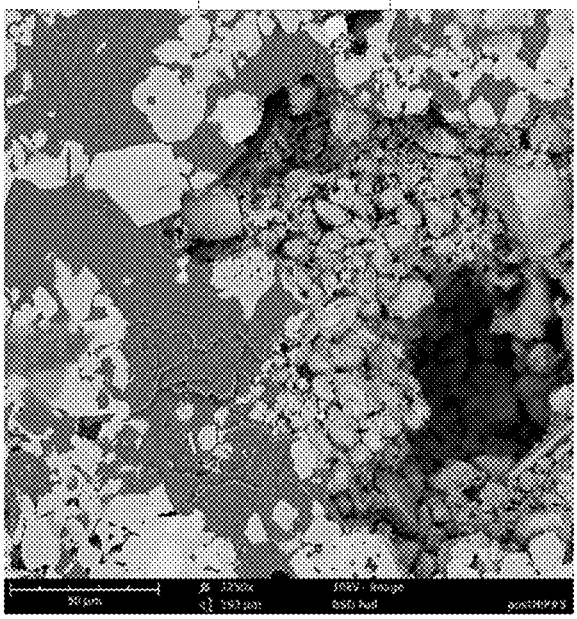
Figure 15C:
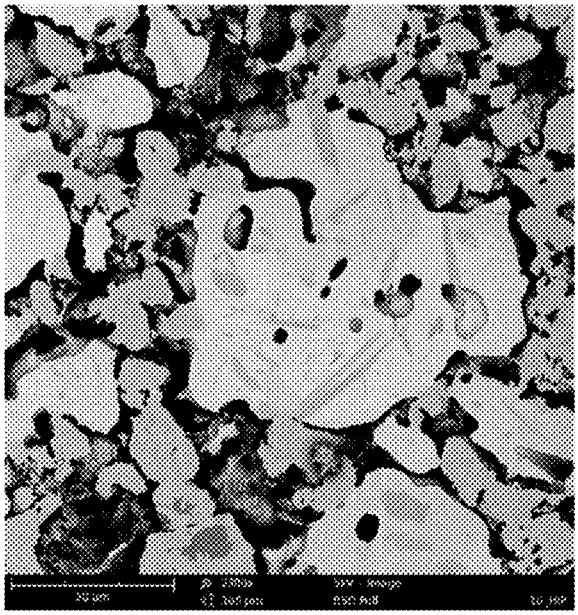
Figure 15D:
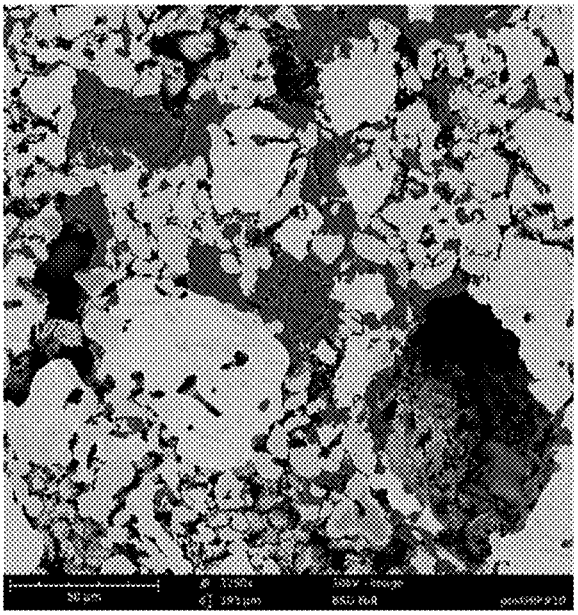

To provide a meaningful viewpoint on the potential value of the proposed approach, it would be very helpful to compare the relative ballistic performance of presently studied product to standard monolithic armor products, such as RHA steel, or Ti, Mg, or Al-based. Unfortunately, the manner in which the ballistic test was carried out in this study does not allow such a comparison to be made very rigid due to the limitation of the size of the plates being tested and their number. However, reasonable estimates of the possible outcome of such a comparison were made. This can be done based on recently published data on Ti64 alloy-based armor manufactured using BEPM. Using a parameter such as specific kinetic energy (SKE) of the bullet (kinetic energy/area of bullet cross-section), it was shown that the Ti64 alloy-based laminate composites require almost twice as higher bullet energy to be pierced compared to the currently used Ti64 alloy armor. Another conventional test, V50, has recently been used that allowed comparison of Ti64 alloy-based materials made using BEPM with open data on commercially available armor made from uniform Ti alloys. Results of such test can be presented by plotting V50 vs. thickness of the plate, where V50 stays for "Velocity-50%", a ballistic test where bullets are fired at changed velocities. The velocity of the bullets where 50% of the bullets don't penetrate, is the V50 rating for that ballistic protection. This test allowed a direct comparison of materials with similar specific density, which can be used to compare layered composite structures made using BEPM with commercially available armor made of Ti64 and other Ti alloys. However, when there is a need to compare the V50 results for some materials with distinctively different density the results can be recalculated accounting for the mass efficiency of tested structures. In this case V50 can be plotted vs. thickness multiplied by density of material. Here, a summary chart from this study on V50 plotted vs. thickness× density data shown in FIG. 14 and illustrates how the data from the present study correlate with other materials including Ti-alloys, RHA steel, aluminum alloy 5083AL and magnesium alloy AZ31 B. As can be seen, given the mass efficiency, Ti alloys (1) exhibit higher performance than RHA steel (5) and (6) and the listed aluminum (7) and magnesium (8) alloys. The results of 3D printed Ti64 armor, are generally well consistent with V50 of commercial Ti rolled alloy armor (1). The data set (3) shows earlier results presented on two- and three-layer alloy Ti64-based laminates, which included composite layers with up to 20% of TiC and TiB. Those results look superior over commercial Ti armor (1). For example, for the same thickness×density, say at 60 mm·g/cm$^3$, V50 is about 650 and 800-900 m/s for commercial Ti alloys and for BEPM laminates correspondingly, which made the improvement between 19 to 27%. However, the dataset (3) reports on composites with reinforcement content not exceeding 20%, and the structures have not been fully optimized in terms of its porosity. The highest hardness value, 373 HV, was reported for a 10% TiC composite with a measured porosity of 3.6%. Other composites listed in this set (3) demonstrated slightly lower hardness and slightly higher porosity values. Now, if materials from the present study are added for comparison, structures with hardness between 683 and 789 HV and porosity much lower or comparable to the dataset (3) should be considered. There is no doubt that the V50 results for present structures manufactured using BEPM+HIP should be significantly higher compared to the data set (3). This prospective is arrowed with (4) in FIG. 14. A similar conclusion can be made about significant increase of SKE required for piercing armor when comparing the present materials to data reported before for Ti-based laminates and a monolithic Ti armor product.

To summarize, the laminate structures of composites on the base of alloy Ti64 reinforced with TiC and TiB can be successfully formed by making each composite layer individually using BEPM and bonding them into a laminate structure using HIP. The combination of the two processing technologies is highly beneficial for the properties and performance of the final product. The most obvious positive effect from the addition of HIP to the production cycle of composites with BEPM is the almost complete removal of residual porosity in final products. The removal of porosity is particularly important when the amount of reinforcement exceeds 10% or so, when this structure deficiency may be relatively high after just BEPM manufacture. The need for such structure improvement becomes particularly acute on laminated composites when standard porosity removal passages, such as hot plastic deformation, cannot be used due to mismatch of plastic flows of different layers. As can be seen, the hardness of PM made composites can be significantly increased after their subsequent HIP treatment. Thus, HIP allows forming dense multilayer sandwich materials in which individual layers differ significantly in chemistry, structure and properties and provide excellent bonding between heterogeneous layers that are difficult or possible to manufacture in other ways. Finally, the high temperature associated with HIP treatment is beneficial for the strengthening of composites, particularly with TiC and TiB. TiC can be transformed in Ti64 at high temperature into various hard phases such as $Ti_2C$ and $Ti_3AlC$, which are both a result of phase transformation that increases the fraction of the hard phases at the expense of relatively soft matrix alloy. With respect to TiB composites, the extended effect of high temperature during HIP may be beneficial in allowing $Ti_2B$ to more fully transform into TiB, forming homogeneously distributed needle/plate morphology of reinforcement. It is also important to note that the borides and carbides in the composites in question result in the formation of new strong interfaces between the matrix alloy and the strengthening phase since they are the results of a chemical reaction. Obviously, this leads to an improvement in the ability of the materials to withstand the applied external load or impact. In fairness note, joining the layers could be also done via the diffusion bonding or friction welding. However, HIP bonding appears to be the most proficient way to build laminates (hard/ductile) from these materials, enabling their superior hardness in specific regions in the range 650-780 HV without compromising low specific weight of the whole part. In addition to layer bonding and mechanical properties improvement due to structure aging, HIP is also effective in increasing hardness by reducing porosity, in which diffusion bonding and friction welding are not as effective. Deformation of the entire structure is very useful for effective bonding creating dislocations that accelerate diffusion, and during HIP bonding, deformation of the structure is effortlessly achieved by closing the residual porosity. For the sake of fairness, it should be noted that the diffusion bonding has the potential to improve properties due to aging of the bulk structure, which is completely prevented by friction welding.

The laminate composite structures on the base of alloy Ti64 reinforced with TiC and TiB can be successfully formed by making each composite layer individually using BEPM and bonding them into a laminate using HIP. Combination of two processing methods allows (i) to minimalize the residual porosity often observed after BEPM manufacturing, (ii) formation of the compact multilayer sandwich structure with the individual layers differ by their chemistry, microstructure and properties and (iii) provide excellent bonding between dissimilar composite layers that is difficult or possible to joint in other ways.

CONCLUSIONS

Ballistic examination of layered composite structures manufactured by BEPM+HIP processing shows that Ti-based structures can successfully withstand the impact of a standard 7.62 caliber steel hardened bullet with the hardness of 870 HV. This result was due to the outstanding hardness values demonstrated by the fabricated composites, which were measured near 790 and 680 HV for 40% composites with TiC and TiB correspondingly.

What is claimed is:

1. An antiballistic laminate structure comprising:

an alloy layer comprising a titanium alloy; and two or more metal matrix composite (MMC) layers, a first MMC layer comprising a titanium alloy reinforced with 40 vol. % to 50 vol. % particles of TiC and a second MMC layer comprising a titanium alloy reinforced with 30 vol. % to 50 vol. % particles of TiB, wherein the first MMC layer and the second MMC layer comprise different amounts of TiC and TiB, respectively:

wherein the titanium alloy of the two or more MMC layers and, optionally, the alloy layer is Ti-6Al-4V;

wherein the alloy layer and the two or more MMC layers are bonded by applying hot isostatic pressing (HIP):

wherein each MMC layer is individually fabricated and processed using Blended Elemental Powder Metallurgy (BEPM) treatment prior to applying HIP; and wherein the antiballistic laminate structure has a porosity of ≤3%, and wherein the two or more MMC layers have a hardness greater than 600 HV.

2. The antiballistic laminate structure of claim 1, wherein the first MMC layer is reinforced with no more than 45 vol. % TiC.

3. The antiballistic laminate structure of claim 1, wherein the second MMC layer is reinforced with no more than 45 vol. % TiB.

4. The antiballistic laminate structure of claim 1, wherein the antiballistic laminate structure has a porosity of ≤2%.

5. The antiballistic laminate structure of claim 4, wherein the applied HIP decreases the porosity of the two or more MMC layers by at least 10% from a porosity level of the two or more MMC layers prior to HIP being applied.

6. The antiballistic laminate structure of claim 4, wherein the applied HIP eliminates residual porosity that was present in the antiballistic laminate structure prior to HIP being applied.

7. The antiballistic laminate structure of claim 1, wherein the two or more MMC layers have a hardness greater than 700 HV.

8. The antiballistic laminate structure of claim 1, wherein the laminate structure has increased hardness, reduced porosity, and improved interlayer bonding strength, thereby providing improved ballistic impact resistance relative to an otherwise identically fabricated laminate made without HIP bonding.

9. The antiballistic laminate structure of claim 1, wherein the laminate structure comprises $Ti_3AlC$.

10. The antiballistic laminate structure of claim 1, wherein the two or more MMC layers comprise a reinforcement phase comprising $Ti_2C$, $Ti_3AlC$, and TiB.

11. The antiballistic laminate structure of claim 10, wherein the reinforcement phase comprises 5 wt. % to 20 wt. % $Ti_3AlC$.

12. The antiballistic laminate structure of claim 10, wherein the reinforcement phase increases in a graded, step-wise manner from 0 wt. % TiC or TiB at the alloy layer up to 50 wt. % within an outer MMC layer.

13. The antiballistic laminate structure of claim 1, wherein the antiballistic laminate structure is in the form of a plate, wherein the plate has a length of about 90 mm to about 30 cm, a width of about 90 mm to about 30 cm, and a thickness of about 10 mm to about 5 cm.

14. The antiballistic laminate structure of claim 1, wherein the HIP is performed at about 800° C. to about 1000° C.

15. The antiballistic laminate structure of claim 14, wherein the HIP is performed at about 100 MPa to about 200 MPa.

16. The antiballistic laminate structure of claim 15, wherein the HIP is performed for about 3 hours to about 5 hours.

17. The antiballistic laminate structure of claim 1, wherein each interface between the layers is well consolidated with no visible pores.

18. An antiballistic laminate structure comprising:

an alloy layer comprising a titanium alloy; and two or more metal matrix composite (MMC) layers, each MMC layer comprising a titanium alloy reinforced with 40 vol. % to 50 vol. % particles of TiC or TiB;

wherein the titanium alloy of the two or more MMC layers and, optionally, the alloy layer is Ti-6Al-4V;

wherein each MMC layer is individually fabricated and processed using Blended Elemental Powder Metallurgy (BEPM) treatment;

wherein the alloy layer and the two or more MMC layers are bonded by applying hot isostatic pressing (HIP) at a temperature of about 800° C. to about 1000° C. and a pressure of about 100 MP a to about 200 MPa for about 3 hours to about 5 hours, thereby forming the antiballistic laminate structure with a porosity of ≤3%;

wherein at least one of the two or more MMC layers comprises a reinforcement phase comprising 5 wt. % to 20 wt. % $Ti_3AlC$; and wherein the two or more MMC layers have a hardness greater than 600 HV.

* * * * *